US007359670B2

(12) United States Patent
Amano et al.

(10) Patent No.: US 7,359,670 B2
(45) Date of Patent: Apr. 15, 2008

(54) IMAGE FORMING APPARATUS

(75) Inventors: Koji Amano, Kanagawa (JP); Jun Nagumo, Kanagawa (JP); Takao Maekawa, Kanagawa (JP); Masahiro Tose, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 281 days.

(21) Appl. No.: 11/028,575

(22) Filed: Jan. 5, 2005

(65) Prior Publication Data

US 2005/0213996 A1 Sep. 29, 2005

(30) Foreign Application Priority Data

Jan. 6, 2004 (JP) ..... 2004-001476
Nov. 24, 2004 (JP) ..... 2004-339288

(51) Int. Cl.
*G03G 15/00* (2006.01)

(52) U.S. Cl. ..... 399/389; 399/23; 400/624

(58) Field of Classification Search ..... 400/624, 400/625, 708; 101/484; 399/16, 23, 370, 399/389, 393
See application file for complete search history.

(56) References Cited

U.S. PATENT DOCUMENTS 5,774,759 A * 6/1998 Tanaka ..... 399/8
6,598,785 B2 * 7/2003 Quaintance ..... 229/191
6,598,795 B1 * 7/2003 Prenn ..... 235/462.01
6,704,122 B2 * 3/2004 Moro et al. ..... 358/1.9
2004/0085563 A1 * 5/2004 Nishimura ..... 358/1.13

FOREIGN PATENT DOCUMENTS

JP A 2003-270872 9/2003

* cited by examiner

*Primary Examiner*—Ren Yan
(74) *Attorney, Agent, or Firm*—Oliff & Berridge PLC

(57) ABSTRACT

In an image forming apparatus, when a general user pulls a paper tray out of the image forming apparatus, changes used paper with another paper having different paper quality to insert the paper tray into the image forming apparatus and operates a touch panel to change the paper quality setting, a CPU stores paper quality data before change in a RAM. The CPU returns the paper quality setting to the paper quality setting before change when a printing job is completed on the paper after paper quality change.

16 Claims, 20 Drawing Sheets

FIG. 2(a)

32

| PAPER QUALITY | PARAMETER | | |
|---|---|---|---|
| | TEMPERATURE | PRESSING FORCE | ... |
| COMMON PAPER | ... | ... | ... |
| HIGH QUALITY PAPER | ... | ... | ... |
| OHP | ... | ... | ... |
| ... | ... | ... | ... |
| ... | ... | ... | ... |

FIG. 2(b)

33

| PAPER SIZE | PAPER QUALITY | | | |
|---|---|---|---|---|
| | COMMON PAPER | HIGH QUALITY PAPER | OHP SHEET | |
| A4 | A | B | | |
| A3 | C | | | |
| B4 | | | | |
| B5 | | | | |

FIG. 2(c)

33

| PAPER SIZE | PAPER QUALITY | | | |
|---|---|---|---|---|
| | COMMON PAPER | HIGH QUALITY PAPER | OHP SHEET | |
| A4 | | A, B | | |
| A3 | C | | | |
| B4 | | | | |
| B5 | | | | |

IMAGE FORMING APPARATUS

BACKGROUND OF THE INVENTION

1. Field of the Invention

The present invention relates to an image forming apparatus, such as a copying machine, a printer, and a composite machine, capable of printing an image onto paper based on a parameter relating to the image formation corresponding to various paper qualities such as common paper, high quality paper and an OHP (over head projector) sheet, and more particularly, an image forming apparatus in which a general user other than an apparatus manager can change the paper quality temporally and can prevent the trouble from occurring in advance.

2. Description of the Related Art

Conventionally, image forming apparatuses, such as copying machines, printers, and composite machines, have used various types of paper having various paper qualities such as high quality paper and the OHP sheet, as well as copying paper.

According to a conventional art, for example, Japanese Patent Laid-open No. 2003-270872 discloses an image forming apparatus in which the parameters relating to the image formation such as a temperature and a pressing force are suitably set so as to correspond to the various paper qualities, thereby improving image quality.

In the above-mentioned conventional art, the number of trays for accommodating the paper is limited, all kinds of paper cannot be accommodated in the trays, and although the paper size can be automatically detected, the detection of the paper quality is not possible. Therefore, the paper quality should be set at the user side.

SUMMARY OF THE INVENTION

However, according to the above-mentioned conventional image forming apparatus, since any user can set the paper quality, the paper quality setting must be changed whenever the paper quality in the tray is changed. As a result, the operation of the image forming apparatus becomes complicated. In addition, when the paper quality is changed and the paper quality setting is not changed, the various disadvantages are occurred. For example, in a state in which the paper quality is set as 'common paper' but the 'OHP' is set in the tray, when the printing is performed as it is, the printing is not completely performed according to the parameters corresponding to the paper quality. Therefore, the trouble such as the jam may be occurred.

On the other hand, since the paper quality setting is not generally performed for every job but is performed in a static or a semi-fixed manner, there are image forming apparatuses in which the paper quality setting is performed only by the apparatus manager. However, when paper quality is temporally changed and printing is performed, it is troublesome to make the apparatus manager to change the paper quality setting whenever the user wants to change the paper quality setting.

Accordingly, the present invention has been made to solve the above-mentioned problems, and it is an object of the present invention to provide an image forming apparatus in which a general user other than an apparatus manager can change the paper quality temporally and can prevent the trouble from occurring after the change of the paper quality.

In order to achieve the above-mentioned object, according to the present invention, there is provided an image forming apparatus for printing an image on paper, a paper quality of which is set for a paper feed tray, based on parameters corresponding to the paper quality, including: a changing unit for changing a paper quality setting previously set for the paper feed tray; and a returning unit for returning the changed paper quality setting to the paper quality setting before change according to a predetermined condition after the paper quality setting is changed by the changing unit.

According to the image forming apparatus of the present invention, although a general user changes the paper quality, when the printing is completed on the paper after the paper quality is changed, the paper quality setting is changed to the original paper quality setting by the returning unit. As a result, a general user other than the apparatus manager can change the paper quality temporally, so that it is possible to prevent the trouble from generating in the following printing.

BRIEF DESCRIPTION OF THE DRAWINGS

Embodiments of the present invention will be described in detail based on the following figures, wherein:

FIGS. 2(*a*) to 2(*c*) are diagrams showing contents stored in a RAM of an image forming apparatus according to the first embodiment of the present invention, wherein FIG. 2(*a*) is a diagram showing paper quality/parameter data, FIG. 2(*b*) is a diagram showing paper tray setting data set by an apparatus manager, and FIG. 2(*c*) is a diagram showing paper tray setting data a part of which is changed by a general user;

DETAILED DESCRIPTION OF THE INVENTION

First Embodiment

Figure 1:
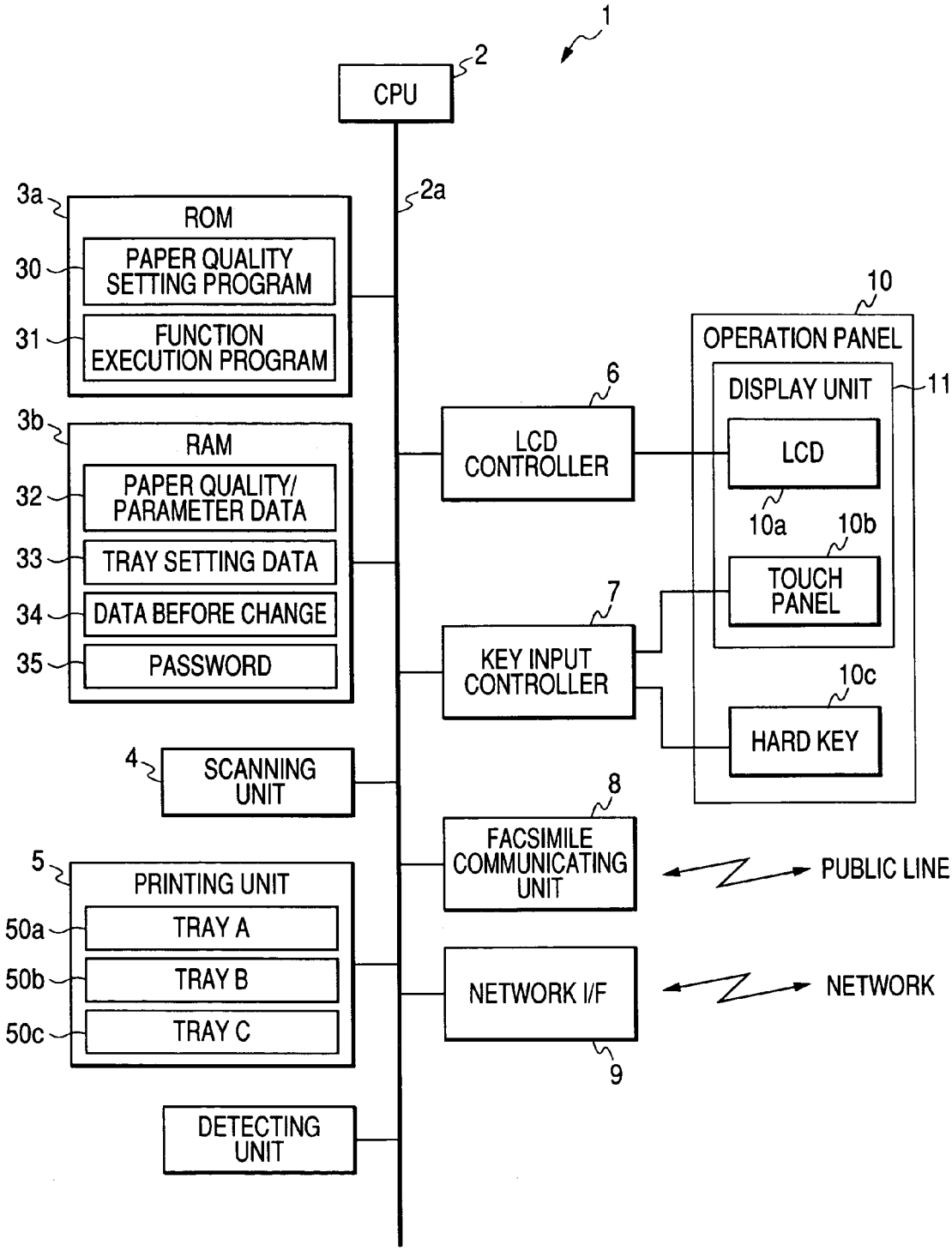
FIG. 1 is a block diagram showing an image forming apparatus according to a first embodiment of the present invention.

FIG. 1 is a diagram showing an image forming apparatus according to a first embodiment of the present invention. The image forming apparatus 1 has a CPU 2 for controlling the overall image forming apparatus 1. To a bus 2*a* of the CPU 2, a ROM 3*a* for storing a control program such as a paper quality setting program 30 and a function execution program 31 carried out by the CPU 2, a RAM 3*b* for storing various data such as paper quality/parameter data 32, tray setting data 33, data before change 34, and a password 35, which will be described in detail later, a scanning unit 4 for optically reading an image from a manuscript, a printing unit 5 for printing the image onto paper fed from any one of paper trays (paper feed trays) 50*a*, 50*b* and 50*c*, an LCD (liquid crystal display) controller 6 for controlling display onto an LCD 10*a*, a key input controller 7 for controlling the input from a touch panel 10*b* and a hard key 10*c* such as a start key, a facsimile communication unit 8 for transmitting and receiving the image via a public line, and a network interface (I/F) 9 for transmitting and receiving the image via a network such as a LAN are respectively connected.

The touch panel 10*b* is arranged on the LCD 10*a* so as to overlap thereon, which constitutes the display unit 11. In addition, the display unit 11 and the hard key 10*c* are arranged on an operation panel 10. The touch panel 10*b* is constructed such that the touch panel 10*b* is pressed by a finger and XY coordinate data corresponding to the pressed position is outputted as a key input signal from the key input controller 7 to the CPU 2.

FIGS. 2(*a*) to 2(*c*) show contents stored in the RAM 3*b*, FIG. 2(*a*) shows paper quality/parameter data, and FIGS. 2(*b*) and 2(*c*) shows tray setting data.

As shown in FIG. 2(*a*), the paper quality/parameter data 32 is one that an apparatus manager registers suitable parameters. Here, the suitable parameters are parameters for image formation, such as a fixation temperature of a fixation roller and a pressing force of the fixation roller, for each paper quality. The parameter illustrated in FIG. 2(*a*) is only an example and is not limited thereto.

As shown in FIGS. 2(*b*) and 2(*c*), the tray setting data 33 serve to determine paper sizes and paper quality types which are currently set with the respective paper trays 50*a* to 50*c* by registering the tray numbers 'A', 'B', and 'C' of the paper trays 50*a*, 50*b* and 50*c* in the regions corresponding to items of the paper sizes and items of the paper quality. FIG. 2(*b*) shows the tray setting data set by the apparatus manager, in which a paper size 'A4' and a paper quality 'common paper' are set so as to correspond to the tray number 'A' of an uppermost paper tray 50*a*, a paper size 'A4' and a paper quality 'high quality paper' are set to correspond to the tray number 'B' of a middle paper tray 50*b*, and a paper size 'A3' and a paper quality 'common paper' are set so as to correspond to the tray number 'C' of a lowermost paper tray 50*c*. FIG. 2(*c*) shows tray setting data in the case that a general user changes a part of the tray setting data in FIG. 2(*b*). This will be described in detail later.

Figure 5:
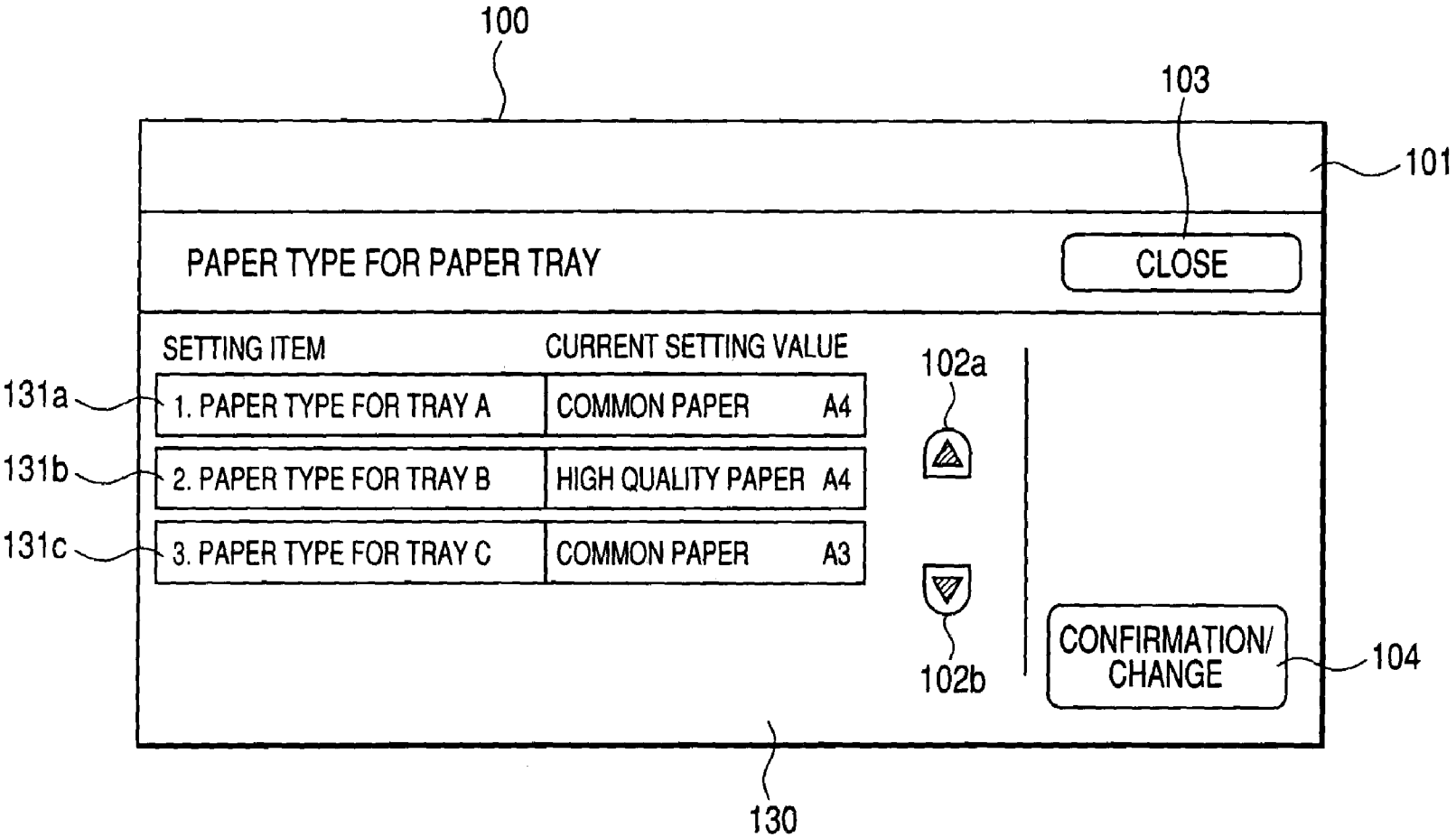
FIG. 5 is a diagram showing a paper tray setting screen displayed on the display screen of the image forming apparatus according to the first embodiment of the present invention.
Figure 6:
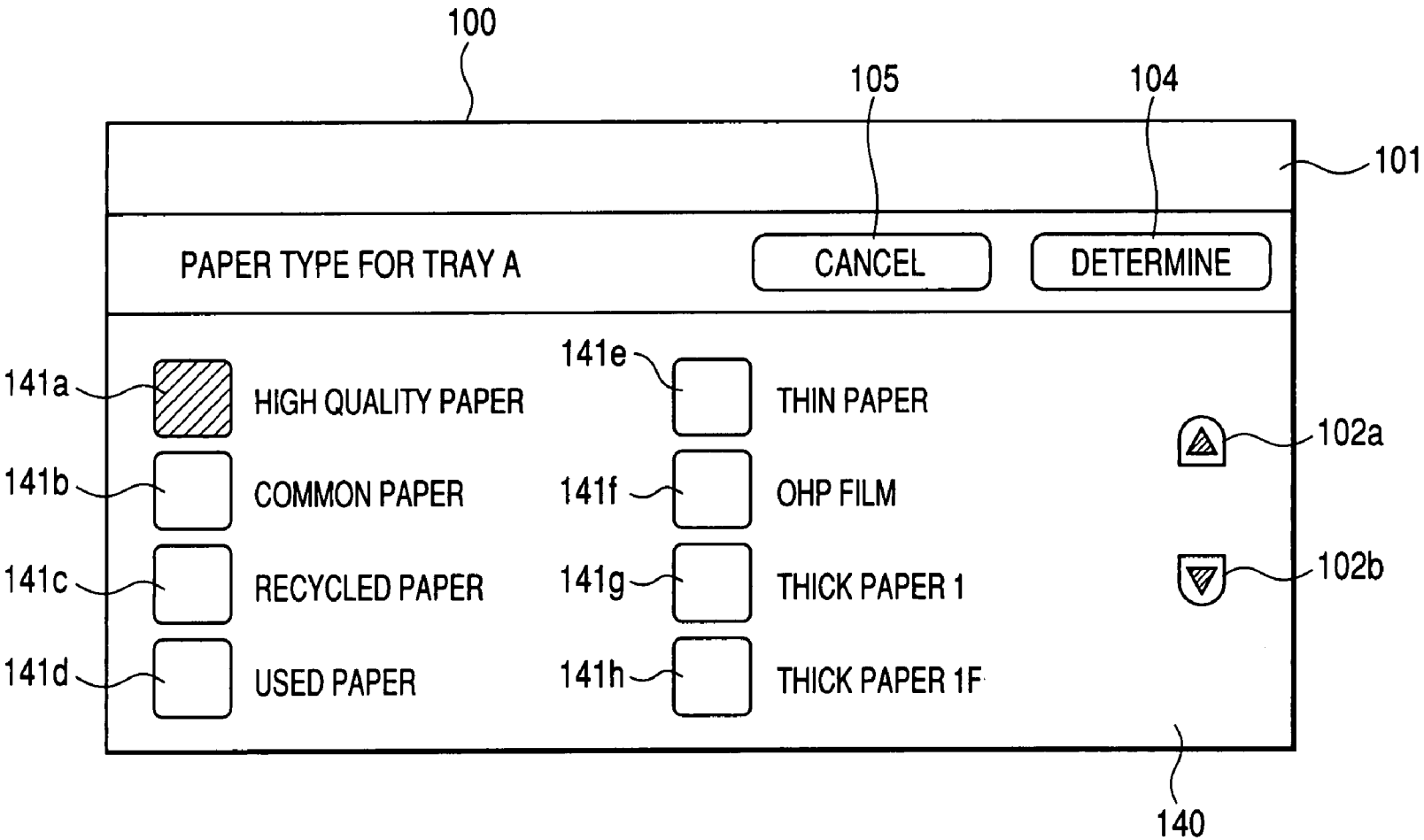
FIG. 6 is a diagram showing a paper type screen for an paper tray displayed on the display screen of the image forming apparatus according to the first embodiment of the present invention.
Figure 7:
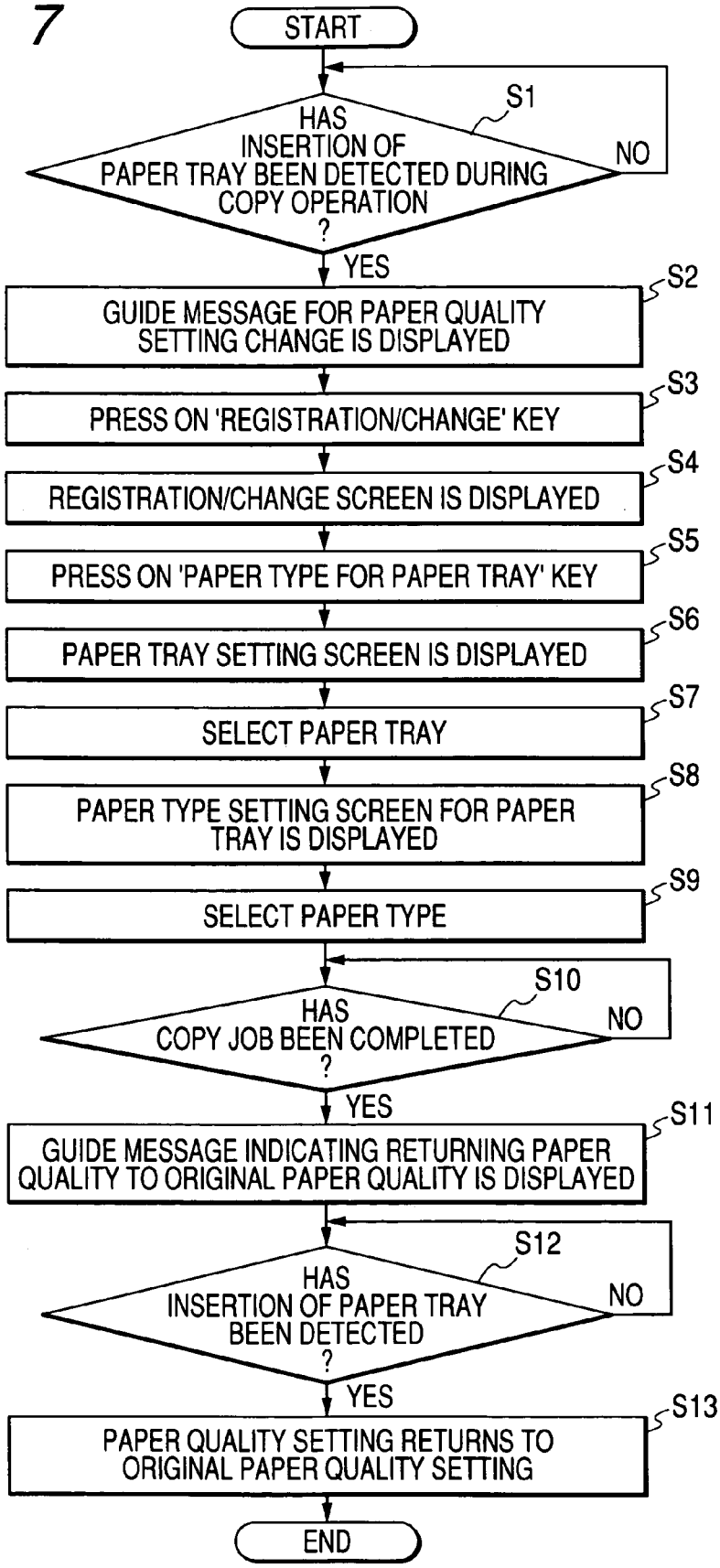
FIG. 7 is a flowchart showing a schematic operation of the paper quality change performed by a general user in the image forming apparatus according to the first embodiment of the present invention.

Next, the operation of the present embodiment is described by making reference to display screens illustrated in FIGS. 3 to 6 and dividing the operation with a schematic flow illustrating the change of the paper quality by a general user as shown in FIG. 7 and the a schematic flow illustrating the change of the paper quality by the apparatus manager. In addition, as long as the subject changing the paper quality is not particularly described in the operation description described below, it is assumed that the CPU 2 changes paper quality. The CPU 2 serves as a unit for changing paper quality and a unit for returning the paper quality.

(1) Changing Paper Quality by a General User

Here, the case in which a general user changes with the high quality paper the common paper accommodated in the uppermost paper tray 50*a* will be exemplified. When the user pulls the uppermost paper tray 50*a* out of the apparatus, changes the set common paper with the high quality paper, inserts the paper tray 50*a* into the apparatus, and the a paper tray sensor serving as a detecting unit detects the insertion of the paper tray, while the user performs a copy operation with respect to the operation panel 10 (S1), the CPU 2 performs a paper quality setting process based on the paper quality setting program 30 stored in the ROM 3*a*, which will be described in detail later.

Specifically, the CPU 2 controls the LCD controller 6 and displays on a message region 101 of a display screen 100 of the LCD 10*a* a message that the setting of the paper quality is changeable, that is, [please press a 'registration/change' key on a menu screen and change the setting on a paper type setting screen for the paper tray] and a message indicating a method of changing the paper quality (sequence until the paper quality setting changing screen is displayed) (S2).

Figure 3:
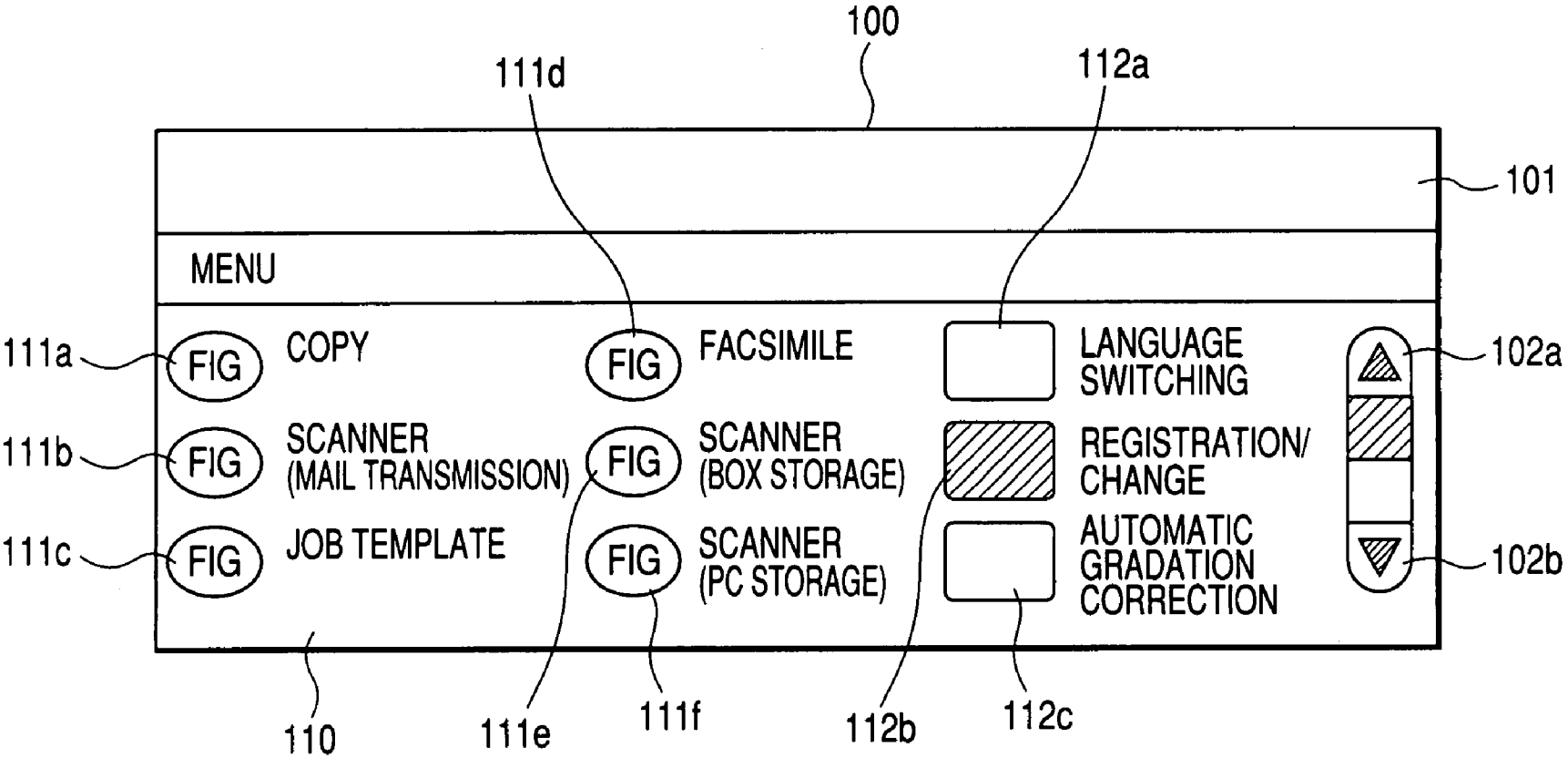
FIG. 3 is a diagram showing a menu screen displayed on a display screen of the image forming apparatus according to the first embodiment of the present invention.

FIG. 3 shows a menu screen. As shown in FIG. 3, on a menu screen 110 displayed on the display screen 100 of the LCD 10*a*, a message display region 101 on which the message is displayed, a plurality of function selection keys 111*a* to 111*e* such as 'copy', 'scanner' or the like, 'a language changing' key 112*a* for changing a displayed language (for example, changing between Japanese and English), a 'registration/change' key 112*b* for registration or registered content change, an 'automatic gradation correction' key 112*c* for correcting the gradation automatically, and an up key 102*a* and a down key 102*b* for changing the menu screen 110 to display it when the menu screen 110 is composed of a plurality of pages. When the user presses on the registration/change' key 112*b* in the menu screen shown in FIG. 3 according to the message of the step 2 displayed on the message display region 101 of the display screen 100 (S3), the CPU 2 displays a registration/change screen shown in FIG. 4 on the LCD 10*a* (S4).

Figure 4:
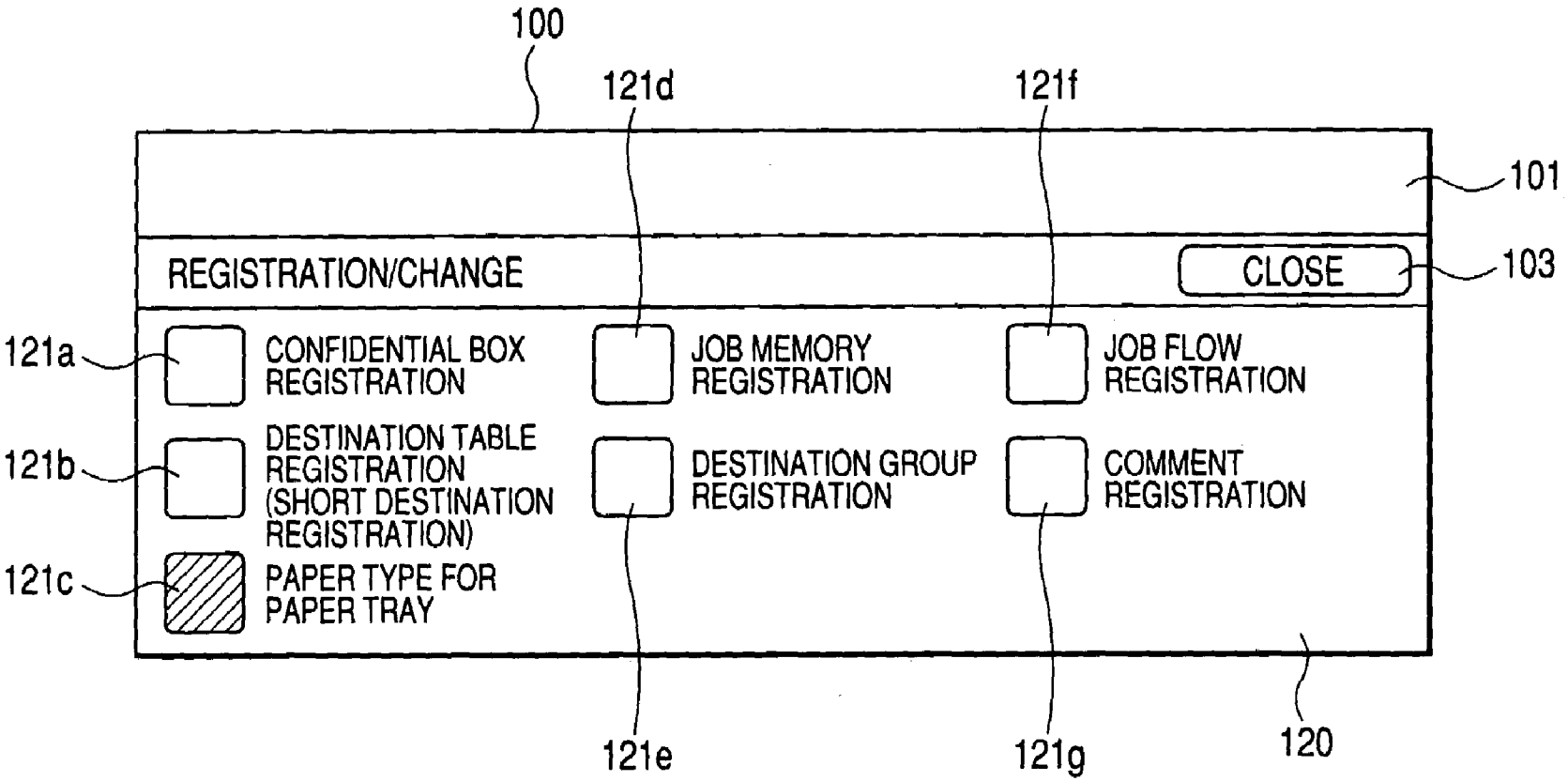
FIG. 4 is a diagram showing a registration/change screen displayed on the display screen of the image forming apparatus according to the first embodiment of the present invention.

FIG. 4 shows the registration/change screen. On the registration/change screen 120 displayed on the display screen 100 of the LCD 10*a*, a plurality of registration selection keys 121*a* to 121*g*, a message display region 101 and a 'closing' key 103 for closing the registration/change screen 120 are displayed. When the user presses on a 'paper type for paper tray' key 121*c* of the registration/change screen 120 (S5), the CPU 2 displays a paper tray setting screen shown in FIG. 5 on the LCD 10*a* (S6).

FIG. 5 shows the paper tray setting screen. On a paper tray setting screen 130 displayed on the display screen 100 of the LCD 10*a*, a plurality of setting item keys 131*a* to 131*c*, a message display region 101, a 'closing' key 103, an up key 102*a*, a down key 102*b*, and a 'confirmation/change' key 104 are displayed. The user selects the paper tray to press on the 'confirmation/change' key 104 (S7). For example, the user displays presses on the setting item key 131*a* to select the paper tray A corresponding to the uppermost paper tray 50*a*. The CPU 2 displays the paper type screen for the paper tray shown in FIG. 6 on the LCD 10*a* (S8).

FIG. 6 shows the paper type screen for the paper tray. On the paper type screen 140 of the paper tray displayed on the display screen 100 of the LCD 10*a*, a plurality of paper type keys 141*a* to 141*h* for setting the paper type is displayed. When the user presses on the 'high quality paper' key 141*a* to change the paper type from the common paper to the high quality paper (S9), the CPU 2 stores in the RAM 3*b* the tray number 'A' and common paper data serving as the data before change 33 before the paper quality is changed, deletes the tray number 'A' registered on the region corresponding to the paper size 'A4' item and the paper quality 'common paper' item of the tray setting data 33 shown in FIG. 2(*b*), and additionally writes the tray number 'A' on the region corresponding to the paper size 'A4' item and paper quality 'high quality paper' item as shown in FIG. 2(*c*). Since the original tray number 'B' had been written on the region, the tray numbers 'A' and 'B' are written on the region. At the time of executing the copy job, if the tray number 'A' is designated, the CPU 2 makes reference to the tray setting data 33 to confirm whether the high quality paper is set. Next, the CPU 2 makes reference to the paper quality/parameter data 32 illustrated in FIG. 2(*a*), so that the CPU 2 controls the respective units of the image forming apparatus 1 based on the parameter corresponding to the high quality paper, thereby executing the copy job.

When the copy job is completed (S10), a guide message indicating returning the paper quality to the original paper quality back is displayed on the message display region 101 of the display screen 100 (S11). For example, the message like [please take the 'high quality paper' out of the tray A and take 'common paper' in the tray A] is displayed thereon. The message is continuously displayed until the paper tray 50*a* is inserted into the apparatus or the message is automatically deleted. When the user pulls the paper tray 50*a* out of the apparatus, sets the 'common paper' which is the original paper quality and inserts the paper tray into the apparatus, and the paper tray sensor detects the insertion of the paper tray into the apparatus (S12), the CPU 2 rewrites the tray setting data 33 with the original state based on the data before change 34 stored in the RAM 3*b* and clears the data before change 34 (S13). As a result, the following copy jobs are carried out according to the parameters corresponding to the original paper quality data.

(2) Changing Paper Quality by an Apparatus Manager

When the apparatus manager presses on the 'password' key in the menu screen, the password input screen is displayed. In addition, when the apparatus manager operates the hard key 10*c* such as the ten key or the like to input the password, the CPU 2 compares the input password with the password 35 stored in the RAM 3*b*, and if the two passwords are the same as each other, the manager screen is displayed. When the apparatus manager presses on the 'paper type for paper tray' key in the manager screen, the paper tray setting screen shown in FIG. 4 is displayed. In addition, when the paper tray is selected, the paper type screen for paper tray shown in FIG. 6 is displayed. When the apparatus manager selects the paper type, the CPU 2 rewrites the tray number on the corresponding region of the tray setting data 33 of the RAM 3*a*. At this time, the paper quality data before change is not stored in the data before change 34. As a result, the following copies are carried out according to the parameters corresponding to the paper quality data after change.

According to the first embodiment, a general user can change the setting of the paper quality without making the apparatus manager troublesome. In addition, since the changing of the paper quality carried out by a general user mainly corresponds to the temporal changing the common paper with a plurality of kinds of special paper such as an OHP sheet, coat paper, tap paper or the like, the image forming apparatus according to the first embodiment has a configuration that the paper quality setting is automatically returned to the original paper quality setting. Therefore, although the general user changes the paper quality, there does not occur a problem.

Second Embodiment

Next, an image forming apparatus according to a second embodiment of the present invention will be described. When the paper tray is pulled out of the apparatus or the paper tray is inserted into the apparatus, the image forming apparatus is constructed such that it performs any one of the following three processes, and the other configuration of the image forming apparatus according to the second embodiment is that same as that of the first embodiment.

(a) The screen for changing the paper quality setting is displayed on the operation panel 10.

(b) A method for displaying the screen for changing the paper quality setting is displayed on the operation panel 10.

(c) Any operation relating to pulling the paper tray out of the apparatus or inserting the paper tray into the apparatus is not performed.

Figure 8:
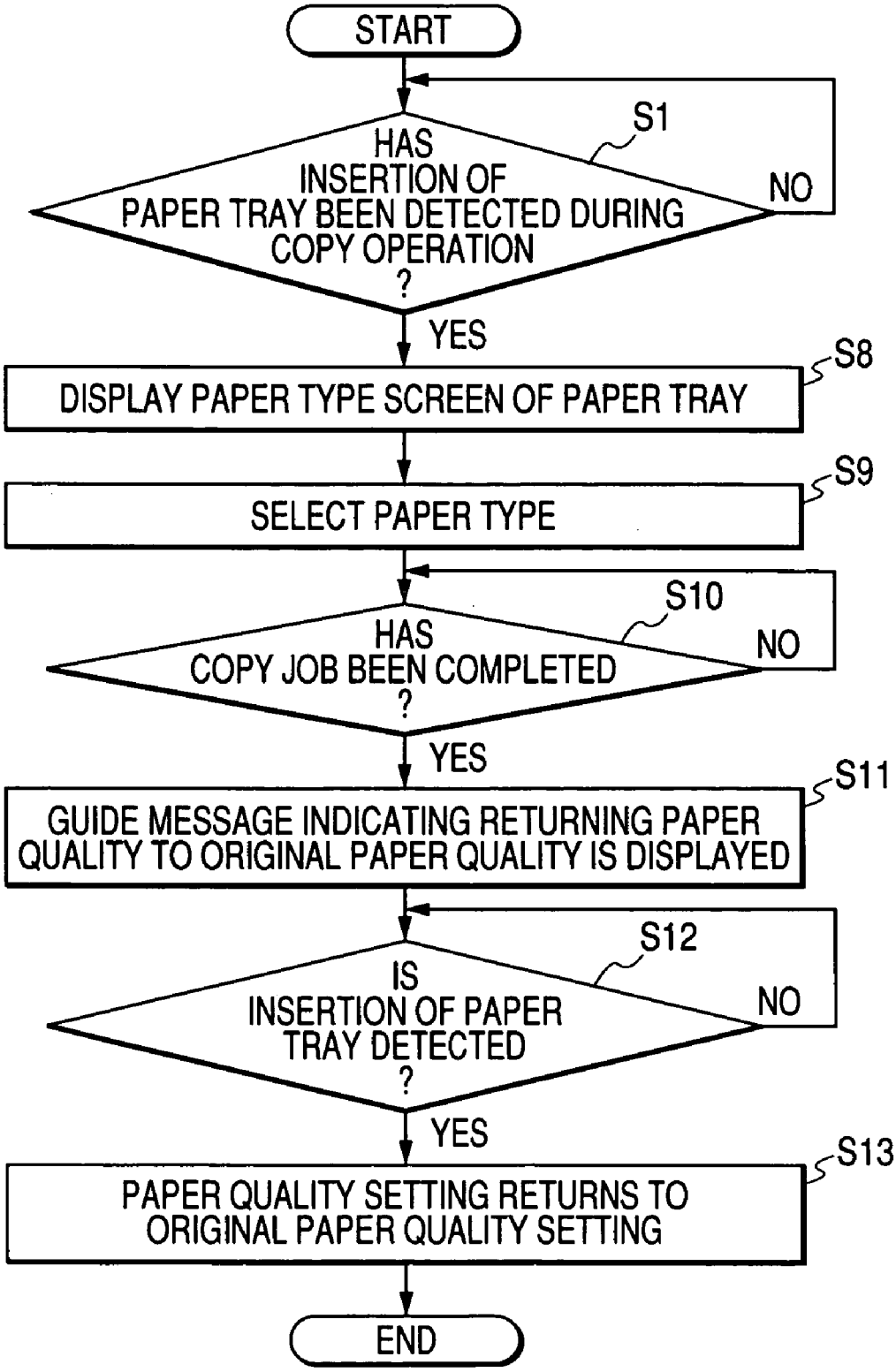
FIG. 8 is a flowchart showing a schematic operation of the paper quality change performed by a general user in an image forming apparatus according to a second embodiment of the present invention.

Next, the operation of the second embodiment will be described with reference to a flowchart of FIG. 8. In FIG. 8, the same steps as those of FIG. 7 are denoted by the same reference numerals. FIG. 8 is a flowchart that the processes of the steps S2 to S7 of FIG. 7 corresponding to the first embodiment are omitted. Here, the case of changing the common paper accommodated in the paper tray 50*a* with the high quality paper will be described.

First, the (a) process will be described. When the user pulls the uppermost paper tray 50*a* out of the apparatus, changes the set common paper with the high quality paper, and inserts the paper tray 50*a* into the apparatus, while the user performs a copy operation with respect to the operation panel 10, the paper tray sensor detects the insertion of the paper tray 50*a* (S1). After the paper tray sensor detects the insertion of the paper tray, the CPU 2 performs the process based on the paper quality setting program 30 stored in the ROM 3*a*. At this time, when setting "the display of the screen for changing the paper quality setting on the operation panel", the paper type screen for paper tray shown in FIG. 6 is displayed on the LCD 10*a* (S8).

On the paper type screen 140 for paper tray of FIG. 6 displayed on the display screen 100 of the LCD 10*a*, a plurality of paper type keys 141*a* to 141*h* for setting the paper type is displayed. When the user presses on the 'high quality paper' key 141*a* to change the paper quality from the common paper to the high quality paper (S9), the CPU 2 stores in the RAM 3*b* the tray number 'A' and common paper data serving as the data before change 34 before the paper quality is changed, deletes the tray number 'A' registered on the region corresponding to the paper size 'A4' and paper quality 'common paper' item of the tray setting data 33 shown in FIG. 2(*b*), and additionally writes the tray number 'A' on the region corresponding to the paper size 'A4' and paper quality 'high quality paper' item as shown in FIG. 2(*c*). Since the original tray number 'B' had been written on the region, the tray numbers 'A' and 'B' are written on the region.

At the time of executing the copy job, if the tray number 'A' is designated, the CPU 2 makes reference to the tray setting data 33 to confirm whether the high quality paper is set. Next, the CPU 2 makes reference to the paper quality/parameter data 32 illustrated in FIG. 2(*a*), so that the CPU 2 controls the respective units of the image forming apparatus 1 based on the parameter corresponding to the high quality paper, thereby executing the copy job.

When the copy job is completed (S10), a guide message indicating returning the paper quality to the original paper quality back, is displayed on the message display region 101 of the display screen 100 (S11). For example, the message like [please take the 'high quality paper' out of the tray A and take 'common paper' in the tray A] is displayed thereon.

When the user pulls the paper tray 50*a* out of the apparatus, sets the 'common paper' of the original paper quality and inserts the paper tray into the apparatus and the paper tray sensor detects the insertion of the paper tray into the apparatus (S12), the CPU 2 rewrites the tray setting data 33 in the original state based on the data before change 34 stored in the RAM 3*b* and clears the data before change 34 (S13). As a result, the following copy jobs are carried out according to the parameters corresponding to the original paper quality data.

Next, when setting the process that "a method for displaying the screen for changing the paper quality setting is displayed on the operation panel as the guide line", which is corresponding to the (b), after the paper tray sensor detects the insertion of the paper tray (S1), the CPU 2 controls the LCD controller 6 and displays on the message display region 101 of a display screen 100 of the LCD 10*a* a message that the setting of the paper quality is changeable, that is, [please press a 'registration/change' key on a menu screen and change the setting on a paper type screen for the paper tray] and a message indicating a sequence until the paper quality set changing screen is displayed (S2). The following process is carried out by the operation of the user as in the first embodiment.

In addition, when setting the process that "any operation relating to pulling the paper tray out of the apparatus or inserting the paper tray in the apparatus is not performed", which corresponds to the (c), although the paper tray sensor detects the insertion of the paper tray (S1), the copy job is performed without any process relating to this being performed.

According to the second embodiment, when the paper tray is pulled out of the apparatus or inserted into the apparatus, if the setting for automatically displaying the screen for changing the paper quality setting onto the operation panel 10 is made, the operation for displaying the screen for changing the paper quality setting is not necessary. In other words, in the case in which the number of times for changing the paper size is large, but the number of times for changing the paper quality is small, in the image forming apparatus 1, irrespective of not changing the paper quality, if the screen until the changing of the paper quality setting is performed in as the steps S2 to S7 of FIG. 7 is displayed whenever the paper tray is pulled out of the apparatus and inserted into the apparatus, the work for closing the screen increases. In this case, the method that the guide message as in the present embodiment is displayed is useful for operation because the unnecessary operation is prevented.

Third Embodiment

Next, the image forming apparatus according to the third embodiment of the present invention will be described. The image forming apparatus according to the third embodiment is one that a function capable of allowing the general user to set the paper quality to the paper having the non-standard size is additionally provided in the image forming apparatus according to the second embodiment.

In addition, similarly to the image forming apparatus according to the second embodiment, the image forming apparatus according to third embodiment is constructed such that when the paper tray is pulled out of the apparatus or is inserted into the apparatus, it can be set to perform any one of the process that "the screen for changing the paper quality setting is displayed on the operation panel", the process that "a method for displaying the screen for changing the paper quality setting is displayed on the operation panel" and the process that "any operation relating to pulling the paper tray out of the apparatus or inserting the paper tray into the apparatus is not performed".

In the case in which the automatic detection is set, when the paper size is the standard size, the paper size can be automatically detected from the paper disposed at the paper tray. However, in the case in which the paper size is the non-standard size, the paper size cannot be automatically detected from the paper disposed at the paper tray. Therefore, the apparatus manager must previously set the paper size by using the screen for apparatus manager. On the other hand, in the case of the paper tray that the paper size is set, although the paper size is the standard size, the paper size is always handled as the set size without being detected. In addition, the number of the paper trays of the image forming apparatus 1 is limited and it is not possible to set all the paper sizes.

Therefore, when the used paper size is not set in the paper tray, the user pulled out the paper tray of the paper that is not used, set the used paper into the paper tray and inserts the paper tray into the apparatus. At this time, when the paper of the non-standard size is set in the paper tray that the automatic detection is set, there are cases in that the paper size can not be detected and the paper size is erroneously recognized as the standard size similar to the non-standard size. In addition, when the paper of the other size is set in the paper tray that the non-standard size is set, the paper of the other size is handled as the original non-standard size. In this case, it is not possible to correctly perform the copy on the paper of size that the user desires. However, according to the present embodiment, these problems can be resolved.

Figure 9:
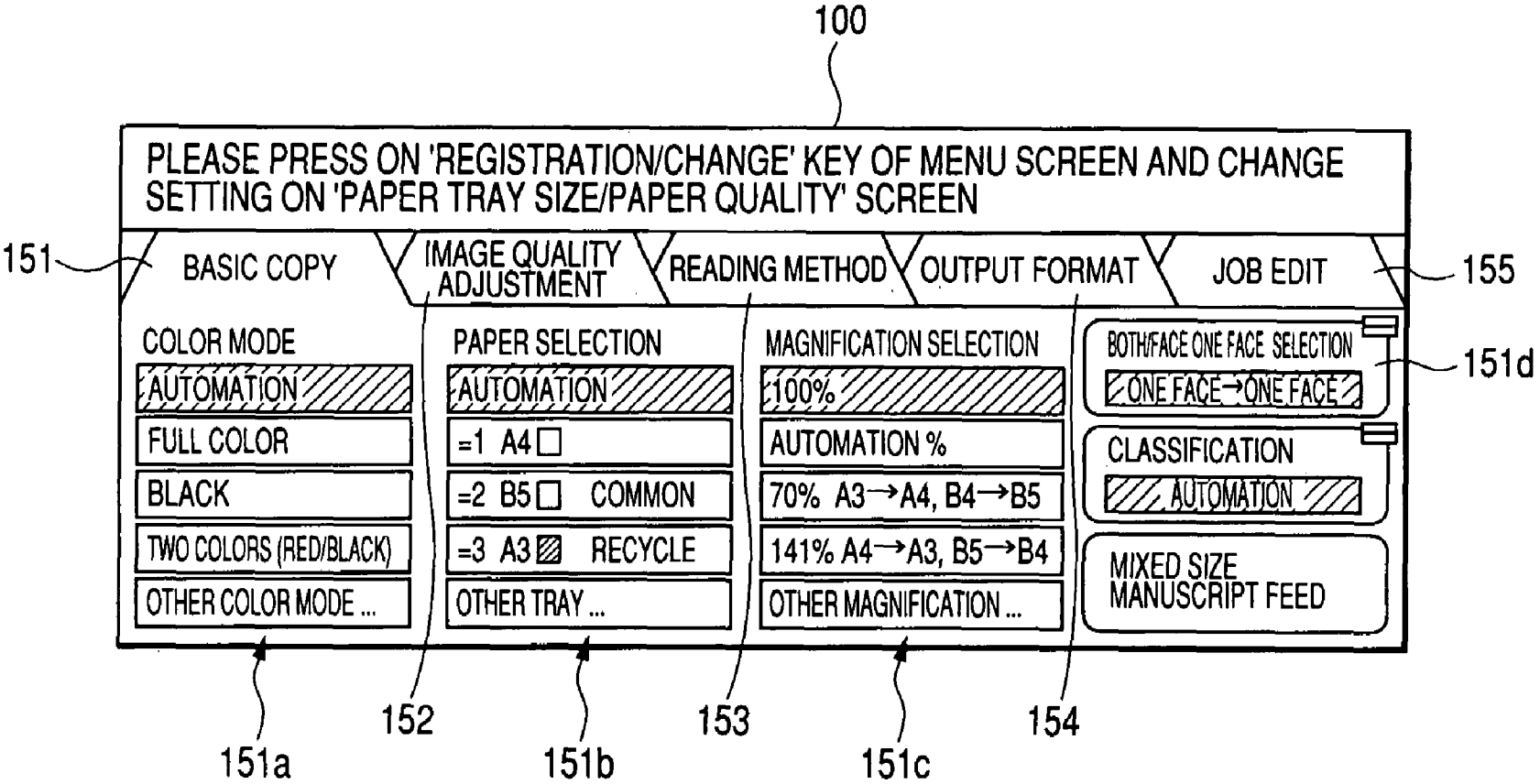
FIG. 9 is a diagram showing a display screen including a basic copy screen in an image forming apparatus according to a third embodiment of the present invention.
Figure 10:
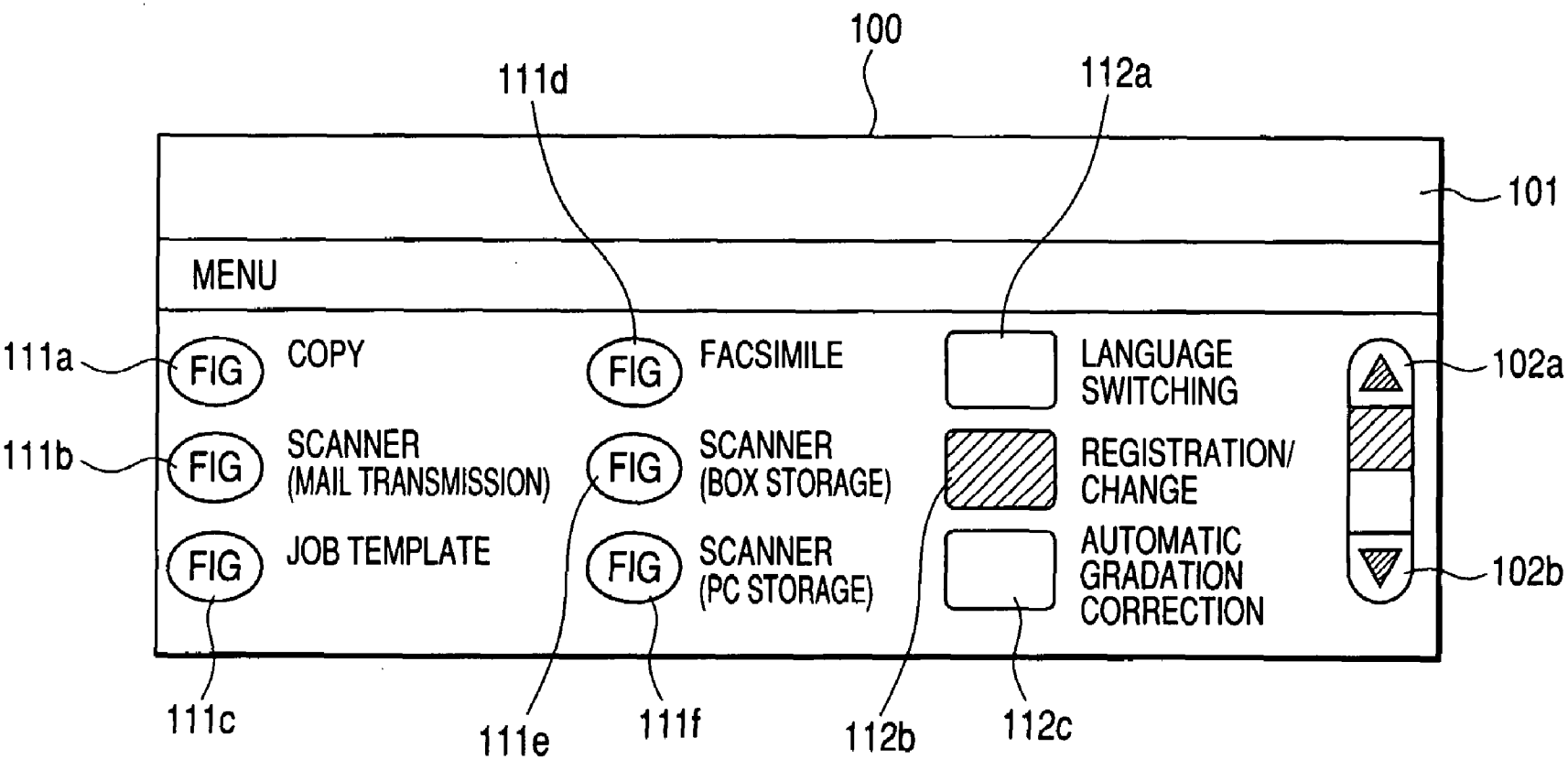
FIG. 10 is a diagram showing a menu display screen.
Figure 12:
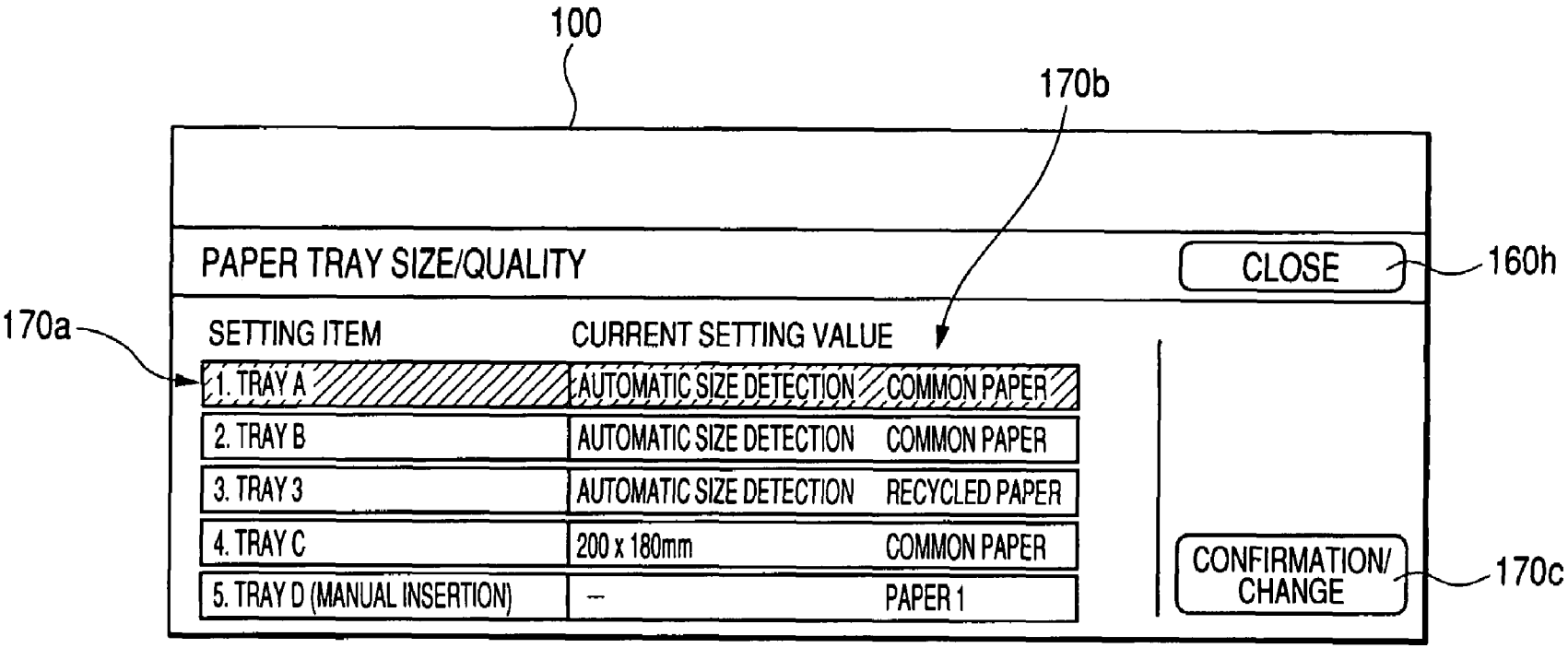
FIG. 12 is a diagram showing a display screen displayed when a 'paper tray size/paper quality' key of FIG. 11 is pressed for selecting the paper quality and the paper size for the paper tray.
Figure 13:
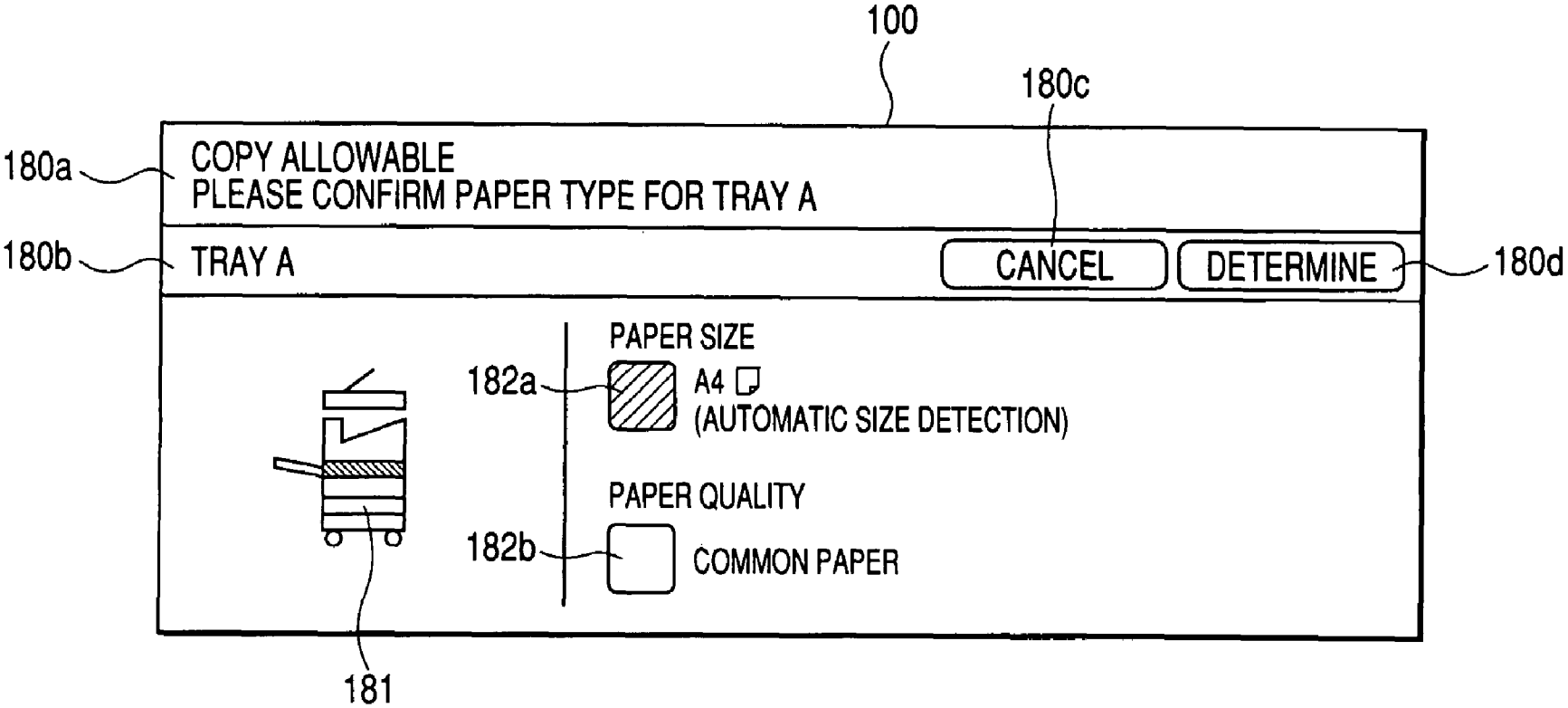
FIG. 13 is a diagram showing a display screen when a 'paper tray 1' of a 'setting item' key of FIG. 12 and a 'automatic size detection/common paper' of a 'current setting value' key are selected and a 'confirmation/change' key is pressed or when a paper tray is pulled out/inserted into.
Figure 14:
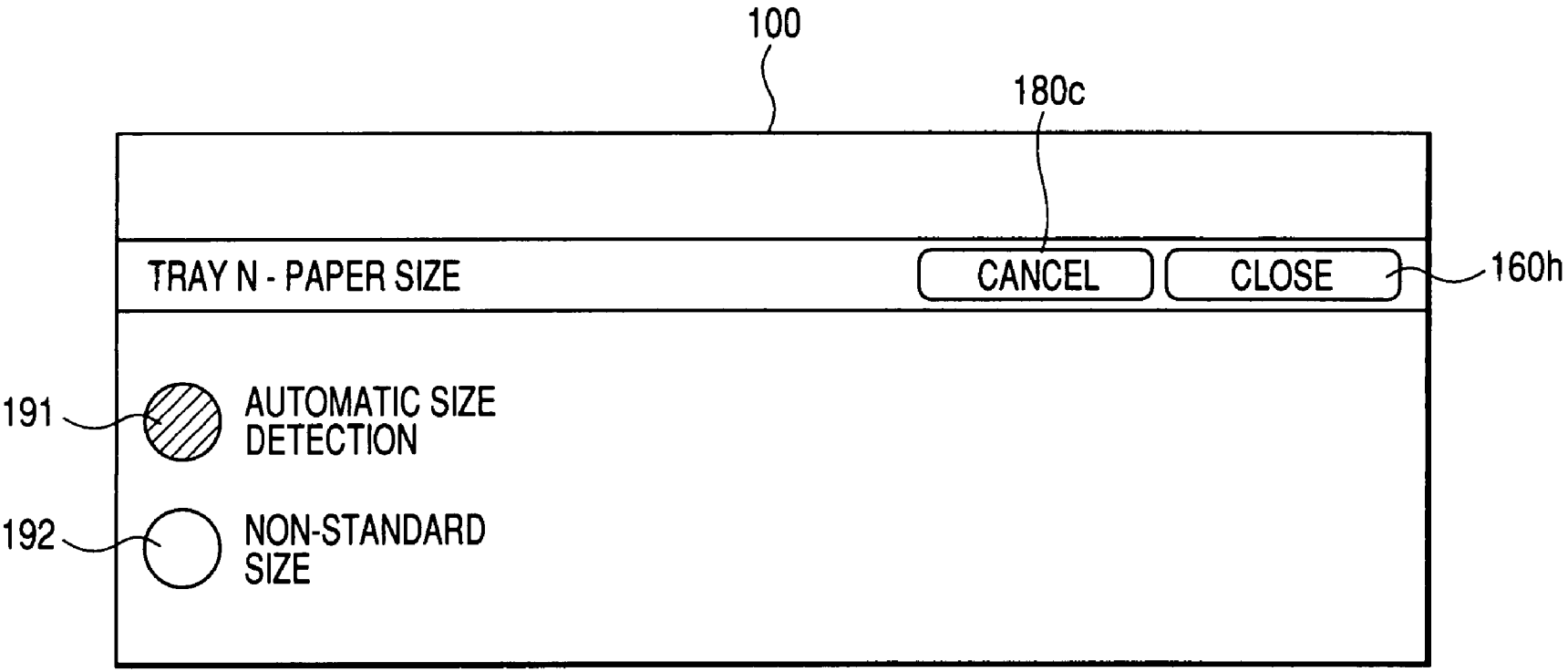
FIG. 14 is a diagram showing a display screen for a paper size setting when a 'paper size' key of FIG. 13 is pressed.
Figure 15:
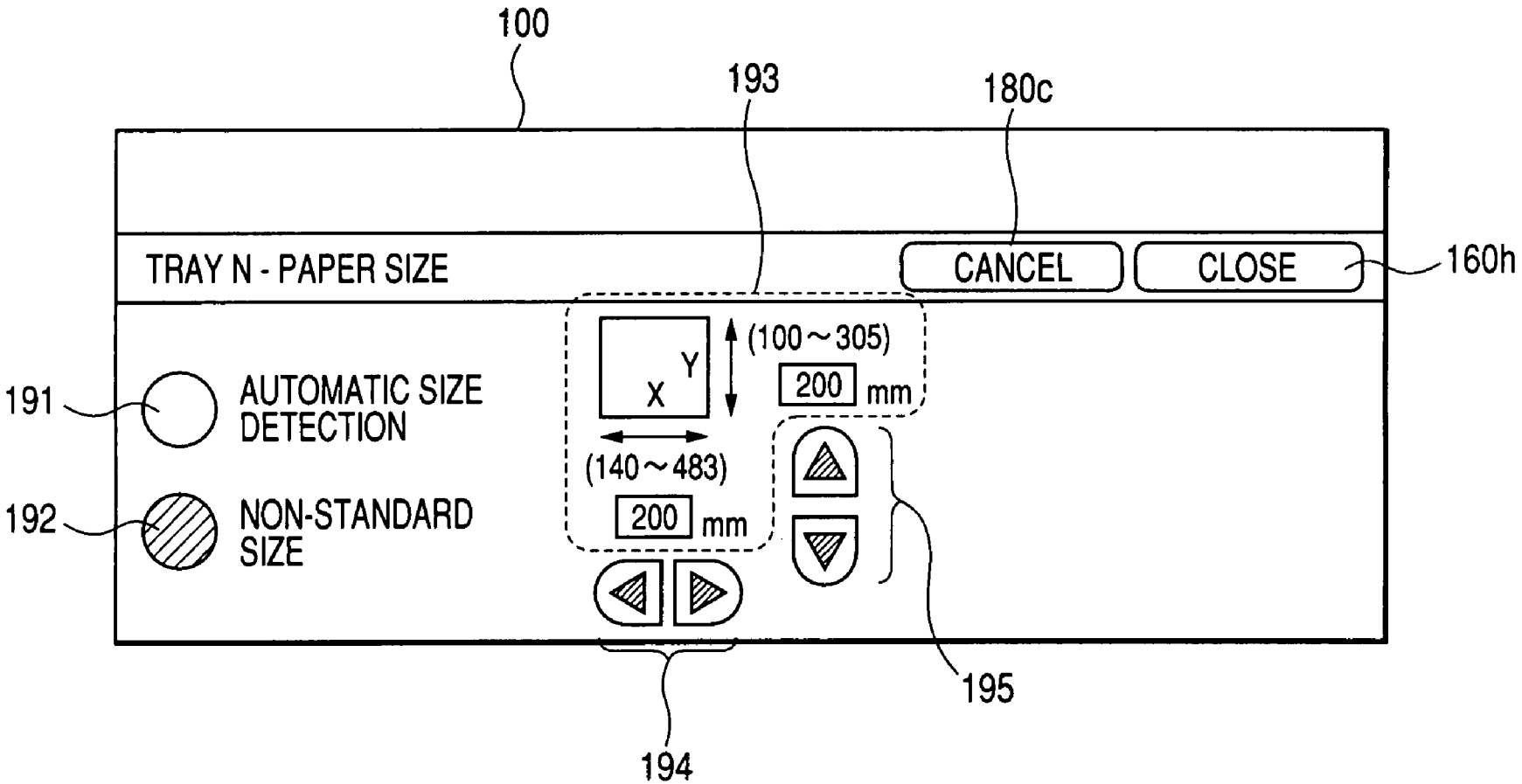
FIG. 15 is a diagram showing a display screen when an 'automatic size detection' key of FIG. 14 is pressed.
Figure 16:
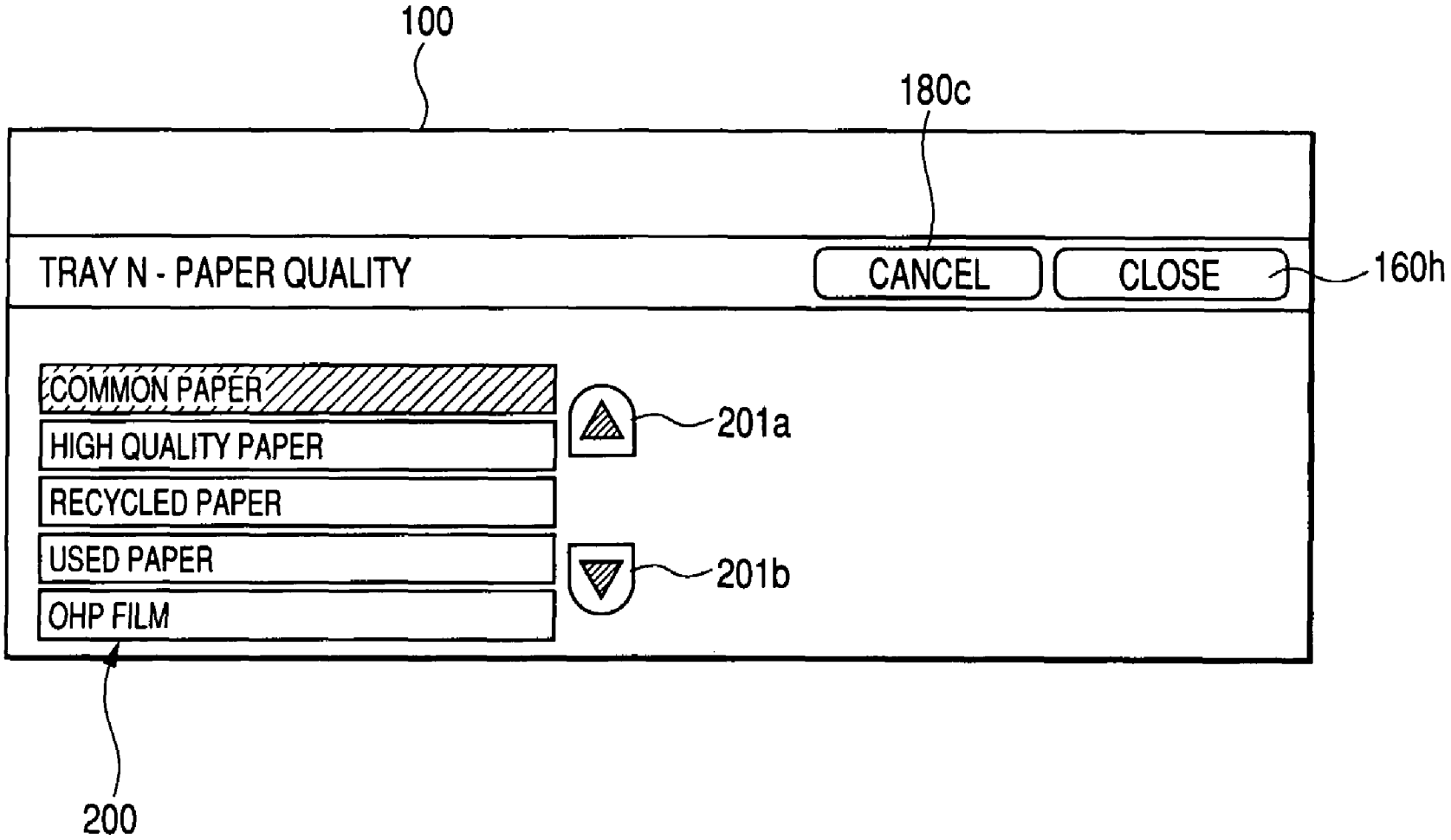
FIG. 16 is a diagram showing a display screen when a 'paper quality' key of FIG. 13 is pressed.

Next, the operation of the third embodiment will be described with reference to FIGS. 9 to 16. FIG. 9 shows a basic copy screen, FIG. 10 shows a menu screen, FIG. 12 shows a screen for setting the size/paper quality of the paper tray, FIG. 13 shows a confirmation screen, FIG. 14 shows a selection screen of an automatic size detection or a non-standard size, FIG. 15 shows an input screen for the non-standard size, and FIG. 16 shows a paper quality setting screen.

Here, the case in which the A4 paper accommodated in the paper tray 50*a* is changed with the non-standard paper having a size of 200 mm×200 mm is exemplified. During copy operation, the user pulls the uppermost paper tray 50*a* out of the apparatus, changes the set A4 paper with the non-standard paper having the size of 200 mm×200 mm, and inserts the paper tray 50*a* into the apparatus. In the case of setting the process that "the method for displaying the screen for changing the paper quality setting is displayed on the operation panel", when the paper tray sensor detects the insertion of the paper tray 50*a*, the CPU 2 executes the paper setting process, which will be described in detail later.

The CPU 2 displays the basic copy screen illustrated in FIG. 9 on the LCD 10*a*. In addition, the CPU 2 displays on the message display region of the basic copy screen of FIG. 9 a message that the setting of the paper quality is changeable, that is, [please press a 'registration/change' key on a menu screen and change the setting on the size/paper quality screen of the paper tray] and a message indicating a method of changing the paper quality setting which is a sequence until the paper quality setting changing screen is displayed.

In the basic copy screen of FIG. 9, a 'basic copy' screen 151, an 'image quality adjustment' screen 152, a 'reading method' screen 153, an 'output format' screen 154 and a 'job edit' screen 155 can be selected.

On the basic copy screen 151, a 'color mode' selection key 151*a* for selecting automation, full color, black or the like, a 'paper selection' key 151*b* for selecting automation, A4, B5 or the like, a 'magnification selection' key 151*c* for selecting automation, 70%, 141% or the like, and a 'faces/one face selection' key 151*d* for selecting one face→one face, classification and mix are displayed.

In the basic copy screen 151 of the display screen 100 of FIG. 9, when the user presses on the 'menu' key other than the LCD (not shown), the screen is switched into the display screen (menu screen) of FIG. 10.

FIG. 10 shows the menu screen. The menu screen 100 has the same structure as that illustrated in FIG. 3. When the user presses on the 'registration/change' key 112*b* of the menu screen, the registration/change screen is displayed.

Figure 11:
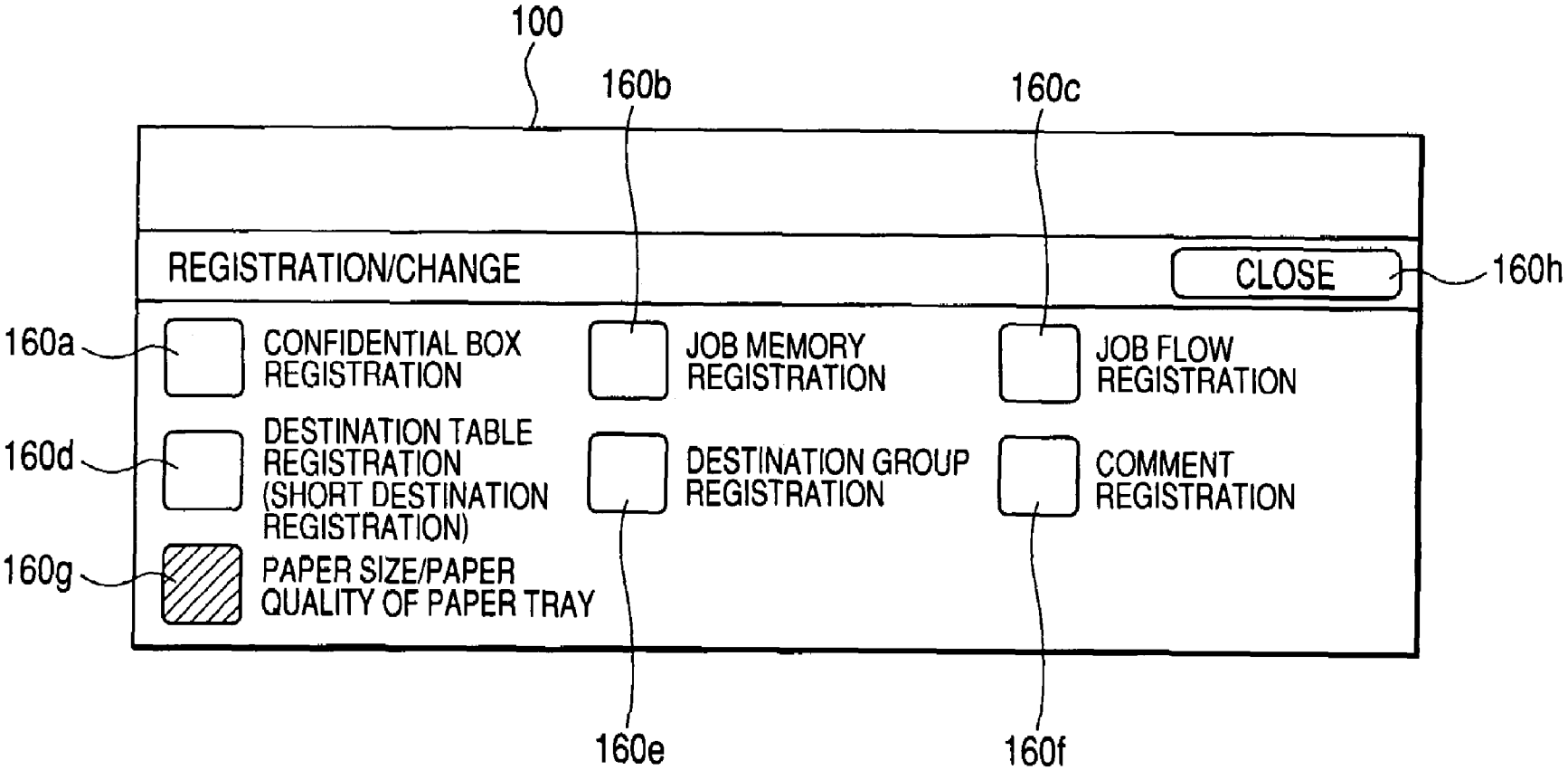
FIG. 11 is a diagram showing a display screen displayed when a 'registration/change' key of FIG. 10 is pressed.

FIG. 11 shows the registration/change screen. On the display screen 100, a 'confidential box registration' key 160*a* for registering the confidential box, a 'job memory registration' key 160*b* for registering the job memory, a 'job flow registration' key 160*c* for registering the job flow, a 'destination table registration' key 160*d* for registering the destination table, a 'destination group registration' key 160*e* for registering the destination group, a 'comment registration' key 160*f* for registering the comment, a 'paper tray size/paper quality' key 160*g* for selecting the paper size and paper quality for the paper tray, and a 'closing' key 160*h* for closing the screen are displayed. When the 'paper size/paper quality' key 160*g* of the registration/change display screen 100 is pressed, the display screen corresponding to the paper tray size/paper quality of the paper tray is displayed thereon.

FIG. 12 shows the display screen of the paper size/paper quality of the paper tray. On the display screen 100, a 'setting item' key 170*a* for selecting the paper tray, a 'current setting value' key 170*b* for selecting the automatic size detection/common paper, a 'confirmation/change' key 170*c* for confirmation or change, and a 'closing' key 160*h* for closing the screen are displayed.

Here, the user selects any one of the paper trays A to D from the 'setting item' key 170*a* in the display screen 100 of FIG. 12 and presses on the 'confirmation/change' key 170*c*. For example, when the user selects the paper tray A (50*a*), the screen is switched into the display screen 100 for setting the paper tray of FIG. 13. In addition, in the case of setting the process that "the screen for changing the paper quality setting is displayed on the operation panel", when the insertion of the paper tray 50*a* is detected, a screen of FIG. 13 is automatically displayed.

FIG. 13 shows the display screen when the 'tray A' of the 'setting item' key 170*a* of FIG. 12 or the 'automatic size detection/common paper' of the 'current setting value' key 170*b* near the setting item key 170*a* is selected and the 'confirmation/change' is pressed or the used paper tray is pulled out of the apparatus and inserted into the apparatus. On the display screen 100, a message display unit 180*a* for displaying the predetermined message, a 'tray name' section 180*b* for displaying the tray names such as A, B, and C, a 'cancel' key 180*c* for canceling the setting, a 'determination' key 180*d* for fixing the setting, a tray arrangement display unit 181, a 'paper size' key 182*a* for designating the paper size, and a 'paper quality' key 182*b* for designating the paper quality are displayed. Here, when the user presses on the 'paper size' key 182*a*, the display screen 100 of the paper size setting of FIG. 14 is displayed.

FIG. 14 shows the display screen 100 of the paper size setting. On the display screen 100, a 'closing' key 160*h*, a 'cancel' key 180*c* for canceling the setting, an 'automatic size detection' key 191 for automatically performing the size detection, and a 'non-standard size' key 192 for selecting the non-standard size are displayed.

When the user selects the 'automatic size detection' key 191 in the display screen 100 of FIG. 14, the paper tray 50*a* is set such that the paper size is automatically detected. In addition, when the 'non-standard size' key 192 is selected, the screen for inputting the paper size is displayed, so that it is possible to set any paper size. Here, when the user presses on the 'non-standard size' key 192 to set the paper size of 200 mm×200 mm, the screen is switched into the display screen 100 of FIG. 15, so that a paper size display unit 193 and size setting keys 194 and 195 are displayed. In addition, when the paper size is changed, the number of the paper tray 50*a* and the original paper size are stored in the previously determined region of the RAM 3*a* by the CPU 2.

FIG. 15 shows the display screen when the 'automatic size detection' key 191 of FIG. 14 is pressed. On the display screen 100, a size-attached paper size display unit 193 and size setting keys 194 and 195 for setting sizes in a horizontal direction and a vertical direction of the paper located to the right of the 'automatic size detection' key 191 and the 'non-standard size' key 192 as well as the 'automatic size detection' key 191 and the 'non-standard size' key 192 are displayed.

At the time in which the copy job is completed, when the paper size is changed, if the number of the paper tray and the original paper size are stored in the RAM 3*a*, the guide message for returning the paper size to the original paper size back is displayed on the message display region. For example, a message like [please take the paper out of the paper tray A and take 'the paper of A4 size' in the paper tray A] is displayed thereon. The message is continuously displayed until the paper tray 50*a* is inserted into the apparatus.

When the user pulls the paper tray 50*a* out of the apparatus and the paper tray sensor detects the insertion of the paper tray into the apparatus without setting the predetermined paper to insert the paper tray into the apparatus, a message indicating a method for changing the paper or the paper size setting screen is displayed. However, after the paper size is changed, the paper size is automatically returned to the original paper size, without displaying the message indicating the method for changing the paper or the paper size setting screen. In addition, the paper size changing paper tray number/paper size storage region is cleared. Hereinafter, the following copy jobs are performed according to the parameters of the original paper setting.

In addition, while the user changes the paper, the print job using the paper tray 50*a* may be in a waiting state or the print job using the alternative paper tray may be performed. In addition, when pressing the 'paper quality' key 182*b* of the display screen 100 for the paper tray setting of FIG. 13, the display screen for the paper quality setting is displayed.

FIG. 16 shows the display screen when the 'paper quality' key 182*b* of FIG. 13 is pressed. The display screen 100 comprises a paper display unit 200 for displaying the paper name such as the common paper, the high quality paper, the recycled paper, a wasted paper and an OHP film, and an up key 201*a* and a down key 201*b* for selecting the paper in the paper display unit 200, as well as the above-mentioned 'cancel' key 180*c* and the 'closing' key 160*h*. The paper quality can be changed.

According to the third embodiment, the following effects can be obtained.

(A) Even though there is not predetermined non-standard paper in the paper tray, the user can set the non-standard paper to use the paper temporally.

(B) After the paper is changed, when the copy/print is completed and the user sets the original paper in the paper tray, the changed paper setting is automatically returned to the original paper setting. As a result, it is possible in advance to prevent the trouble from generating in the next print job.

(C) When the setting of the paper size is changed, it is possible to allow the user to change the paper size setting.

(D) When the paper tray is pulled out of the apparatus or inserted into the apparatus, a message for guiding the method for changing the paper size setting is displayed on the operation panel 10, so that the changing of the size can be urged. As a result, it is possible for the user to change the paper size easily. In addition, when the paper tray is pulled out of the apparatus or inserted into the apparatus, the screen for changing the paper size setting is automatically displayed on the operation panel 10. Therefore, the user can change the paper size.

(E) In the case in which the paper size is changed by the user, when the job such as the copy/print or the like is completed, since a message requiring changing the paper size to the original paper size is displayed, it is possible to prevent the trouble from generating in the following copy/print. In addition, when the paper tray is pulled out of the apparatus/inserted into the apparatus after the message display, the paper size is automatically returned to the original paper size without displaying the message indicating the method for changing the paper size setting or the screen for changing the paper size setting. Therefore, the user can use the apparatus very easily.

Fourth Embodiment

Next, the image forming apparatus according to a fourth embodiment of the present invention will be described. The image forming apparatus according to the fourth embodiment is configured such that after the paper quality is changed, when the copy/print is completed, the image forming apparatus performs any one of the following processes.

(a) The screen for urging returning the paper to the original paper is displayed on the operation panel 10.

(b) The paper is automatically returned to the original paper.

(c) Any process is not performed.

Figure 17:
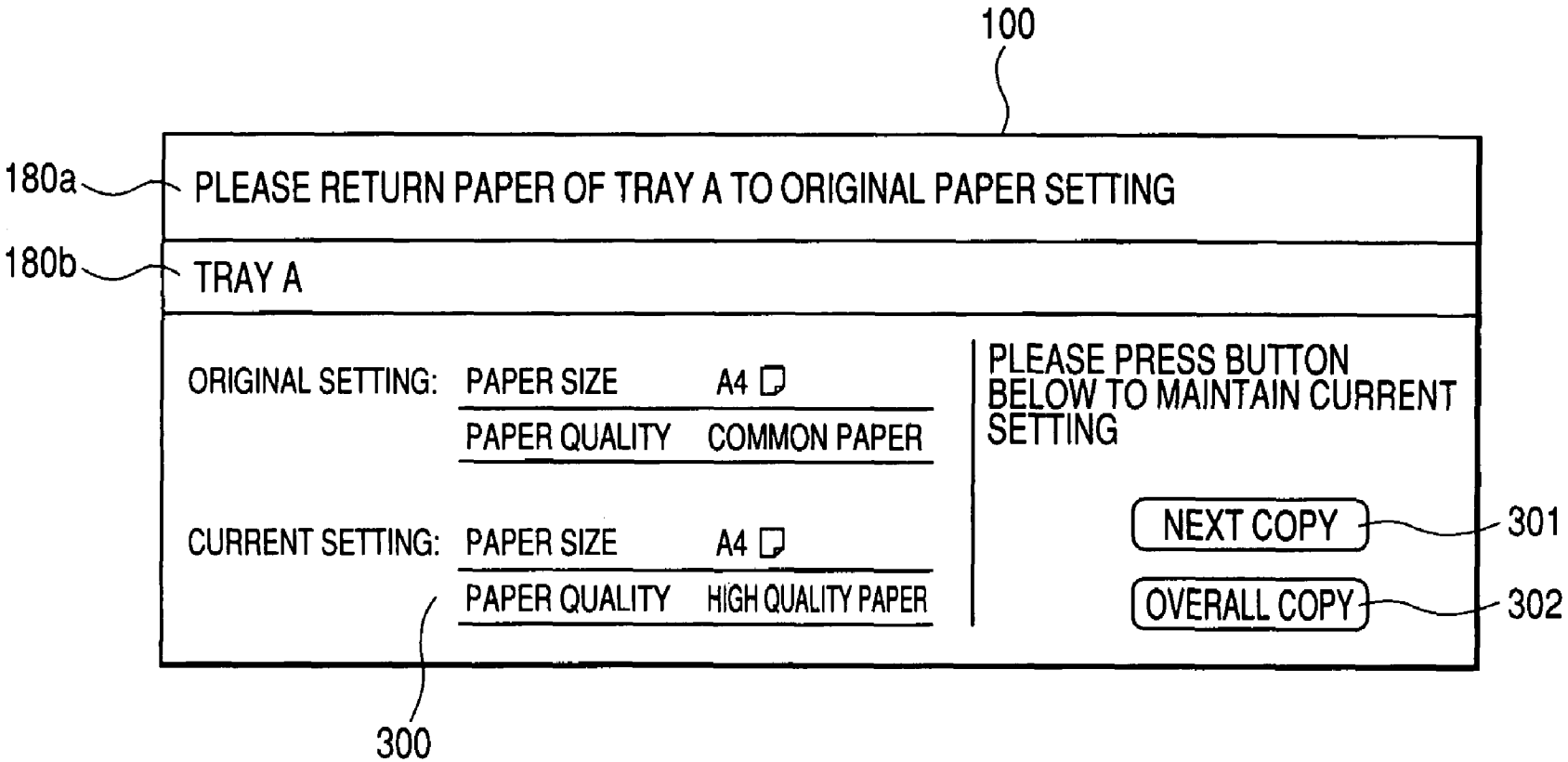
FIG. 17 is a diagram showing a display image for the paper tray confirmation after the tray setting in an image forming apparatus according to a fourth embodiment of the present invention.
Figure 18:
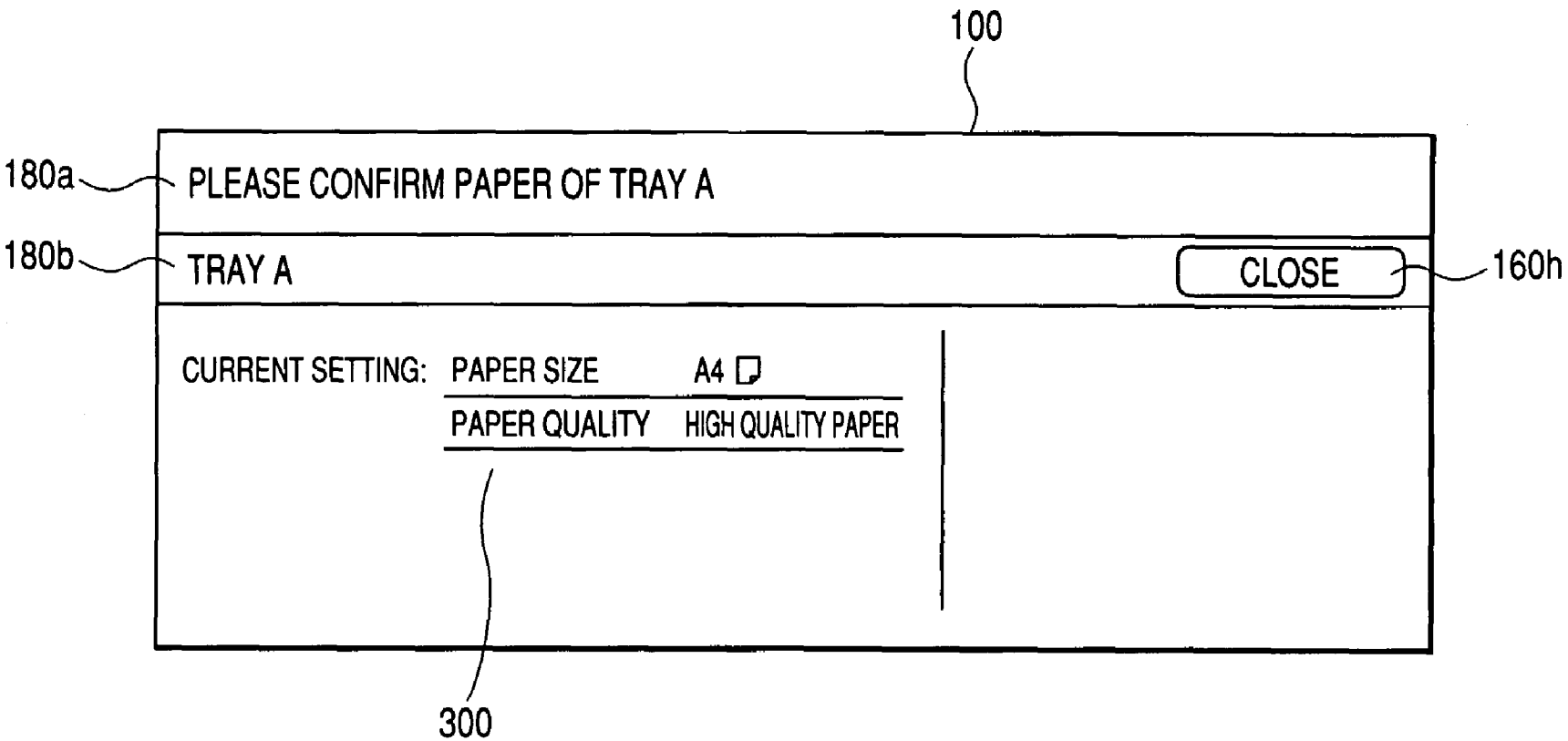
FIG. 18 is a diagram showing a display screen for the paper tray confirmation after display of FIG. 17.

FIGS. 17 and 18 show the display image of the image forming apparatus according to the fourth embodiment of the present invention. FIG. 17 shows the display screen 100 of the paper tray confirmation after the paper setting. The display screen comprises a message display unit 180*a* for displaying a message like [please return the paper of the paper tray to the original paper setting], a 'paper tray name' section 180*b*, a set content display unit 300 for displaying the original setting and the current setting, a 'next copy' key 301, and a 'overall copy' key 302.

Next, the operation of the fourth embodiment will be described with reference to FIGS. 17 and 18. FIG. 17 shows a paper tray confirmation screen and FIG. 18 shows a paper tray confirmation screen. Here, the case in which the common paper accommodated in the paper tray 50*a* is temporality changed to the high quality paper will be described.

When setting the process that 'the screen for urging returning the paper to the original paper is displayed on the operation panel 10', which corresponds to the (a), the user pulls the paper tray 50*a* out of the apparatus and changes the set common paper with the high quality paper. After that, the user inserts the paper tray 50*a* into the apparatus to change the paper setting through the predetermined sequence. At this time, the original paper setting such as the number of the paper tray 50*a* and the paper size or the paper quality is stored in the previously determined region of the RAM 3*b*. After that, the copy is performed.

When the copy/print job is completed, the paper size or paper quality is changed, the paper selecting such as the number of the paper tray and the paper size is stored in the previously determined region of the RAM 3*b* and the process that 'the screen for urging returning the paper to the original paper is displayed on the operation panel 10' is set. The CPU 2 displays the paper tray confirmation screen of FIG. 17. The display screen 100 is displayed until the paper tray 50*a* is inserted in the apparatus or until the user presses on the 'next copy' key 301 or the 'overall copy' key 302 corresponding to the 'the current set maintenance' section. When the 'next copy' key 301 is pressed, the current setting is maintained with respect to the next copy. In addition, when the 'overall copy' key 302 is pressed, the current setting is maintained with respect to the overall following copies including the next copy.

When the user pulls the paper tray 50*a* out of the apparatus, set the paper into the paper tray to insert the paper tray into the apparatus, and the paper tray sensor detects the insertion of the paper tray, the data is read from the paper tray number/paper quality setting storage region for paper size/paper quality change in the RAM 3*b* and the paper tray confirmation screen of FIG. 17 is displayed. When the display screen 100 of FIG. 17 is displayed, if the 'next copy' key 301 corresponding to the 'current set maintenance' section is pressed by the user, the CPU 2 maintains the paper tray number/paper quality setting storage region for paper size/paper quality change and the paper setting of the paper tray as they are and closes the display screen 100 of FIG. 17. The next copy uses the paper size/paper quality be temporarily changed. When the 'overall copy' key 302 is pressed, the CPU 2 clears the paper tray number/paper quality setting storage region for paper size/paper quality change, maintains the paper setting of the paper tray as it is, and closes the display screen 100 of FIG. 17. The following copy jobs are carried out according to the paper setting after change.

FIG. 18 shows the confirmation screen of the paper tray. On the confirmation screen of the paper tray, a message display unit 180*a* for displaying a message like [please confirm the paper of the paper tray] and the set content display unit 300 for displaying the current setting are displayed. The display screen 100 of FIG. 18 is displayed until the display screen is automatically cleared or until the user presses on the 'closing' button 160*h*. The following copy jobs are carried out according to the original paper setting.

When setting the process (b) that "the paper is automatically returned to the original paper", the guide message like [please take the 'high quality paper' out of 'the paper tray' and take the 'common paper' in the paper tray] is displayed on the message display region of the display screen 100 (basic copy screen) of FIG. 9. The message is displayed until the paper tray 50*a* is inserted or until the message is automatically cleared. When the user pulls the paper tray 50*a* out of the apparatus, set the paper into the paper tray to insert the paper tray into the apparatus, and the paper tray sensor detects the insertion of the paper tray, the data is read from the paper tray number/paper quality set storage region for paper size/paper quality change in the RAM 3*b*, the paper setting is returned to the original paper setting, and the paper tray number/paper size/paper quality storage region is cleared. The following copy jobs are carried out according to the original paper setting. In addition, when the paper size accommodated in the paper tray 50*a* is changed, the same process is performed.

When setting the process that "any process is not performed", which corresponds to the (c), although the paper tray sensor detects the insertion of the paper tray 50*a*, the process is completed without performing any process.

According to the fourth embodiment, the following effects can be obtained.

(A) When the copy/print job is completed after paper change, the original paper setting and the current paper setting are displayed on the operation panel 10, and the returning the currently used paper to the original paper is urged. In addition, it is possible to designate that the currently used paper is continuously used. As a result, it is possible to set the next copy/print with the optimal parameter corresponding to the paper quality.

(B) When the copy/print job is completed after paper change, the original paper setting and the current paper setting are displayed on the operation panel 10, and the returning the currently used paper to the original paper is urged. In addition, when the user returns the paper to the original paper, the paper setting after change can be continually maintained. Therefore, it is possible to prevent the trouble from generating in the following copy jobs.

(C) When the copy/print job is completed after paper change, the three processes, that is, the process that the screen urging returning the currently used paper to the original paper are displayed on the operation panel 10, the process that the paper is automatically returned to the original paper, and the process that any process is not performed can be selected. As a result, it is possible to perform the next copy/print job effectively, so that the user can easily perform the copy/print job.

Fifth Embodiment

Next, the image forming apparatus according to the fifth embodiment of the present invention will be described. According to the fifth embodiment of the present invention, the image forming apparatus has a function for selecting the paper automatically and can set the priority order with respect to the plurality of paper trays. In addition, the CPU 2 controls the printing unit 5 such that the paper of the paper tray having the higher priority order according to the set priority order is used among the paper trays in which the paper having the same paper size are accommodated. In addition, when the setting change of the paper quality is performed by the general user, the CPU 2 set the first priority order with respect to the paper tray that the setting of the paper quality is changed.

Figure 19:
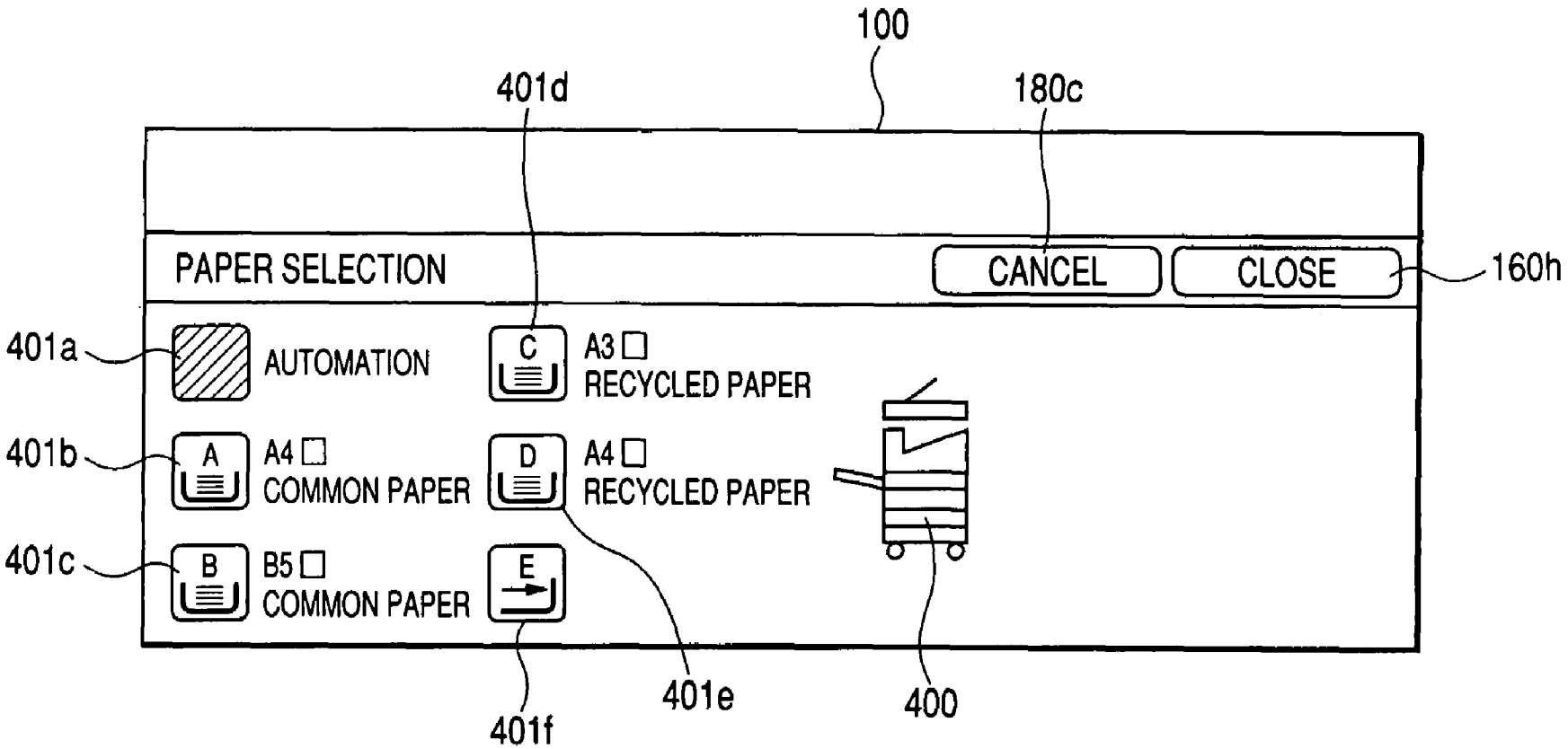
FIG. 19 is a diagram showing a paper selection display screen of an image forming apparatus according to a fifth embodiment of the present invention.
Figure 20A:
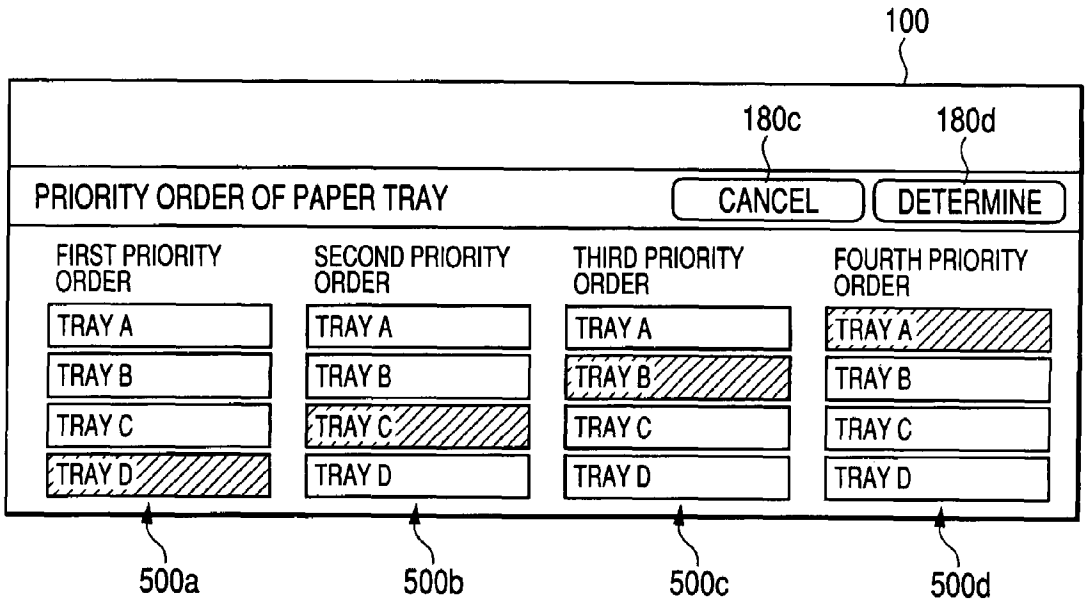
FIGS. 20(*a*) and 20(*b*) are diagrams showing display screens of priority orders of paper trays of the image forming apparatus according to the fifth embodiment of the present invention.
Figure 20B:
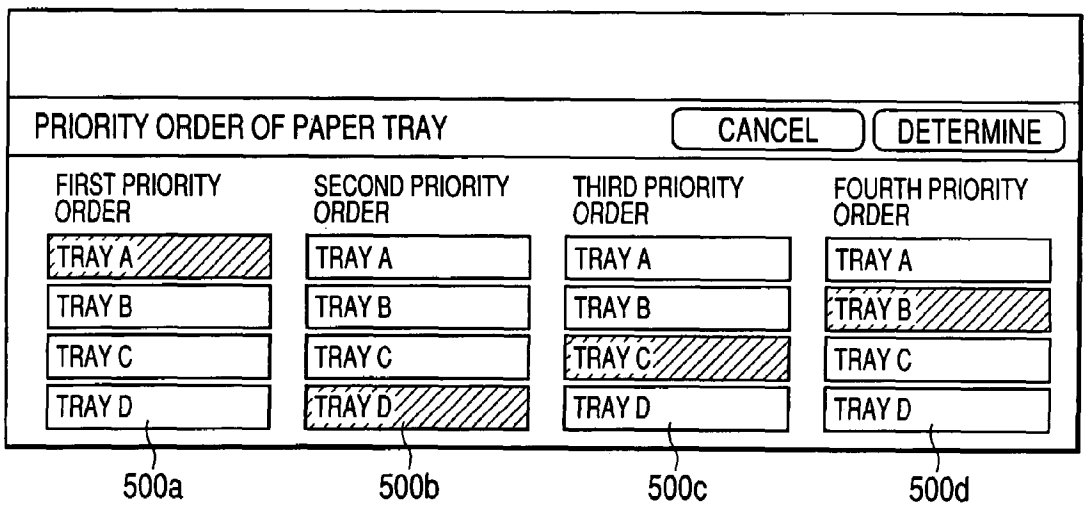

The operation of the fifth embodiment will be described with reference to FIGS. 19, 20A and 20B. FIG. 19 shows the paper setting screen. The paper setting screen is displayed when the 'other tray' of the basic copy screen illustrated in FIG. 9 is selected. FIGS. 20(*a*) and 20(*b*) show the priority order setting screen of the paper tray.

As shown in FIG. 19, pressing the 'automation' key 401*a* serves to select the automatic paper selecting function. On the paper selection screen of FIG. 19, a 'cancel' key 180*c*, a 'closing' key 160*h*, a paper tray model display unit 400 illustrating the combination of the plurality of paper trays, a tray A, a tray B, a tray C, a tray D, a 'tray A' selection key 401*b*, a 'tray B' selection key 401*c*, a 'tray C' selection key 401*d*, a 'tray D' selection key 401*e* and a 'manual insert tray' selection key 401*f* for selecting the manual insertion tray as well as the 'automation' key 401*a* are displayed. In FIG. 19, A4 common paper is set in the tray A, B5 common paper is set in the tray B, A3 recycled paper is set in the tray C, and common paper having various sizes is set in the manual insert tray.

As shown in FIG. 20(*a*), the priority order of the paper trays is set in order of the paper tray D, the paper tray C, the paper tray B, and the paper tray A. In addition, as shown in FIGS. 20(*a*) and 20(*b*), on the priority order setting screen of the paper tray, a 'cancel' key 180*c*, a 'determination' key 180*d*, a 'first paper tray' selection key 500*a* a 'second paper tray' selection key 500*b*, a 'third paper tray' selection key 500*c*, and a 'fourth paper tray' selection key 500*d* for selecting the paper trays having the first priority order, the second priority order, the third priority order, and the fourth priority order are displayed.

Here, the case in which A4 common paper accommodated in the paper tray 50*a* is changed to A4 high quality paper to copy A4 paper and the A4 manuscript is copied is exemplified.

The user pulls the paper tray 50*a* (paper tray A) out of the apparatus, changes the A4 common paper set in the paper tray A with the A4 high quality paper, and inserts the paper tray 50*a* into the apparatus. After that, when the paper setting is changed by the predetermined process, the CPU 2 saves the priority order of the paper trays of FIG. 20(*a*) in another region of the RAM 3*a*, and changes the priority order of the paper tray A with the first priority order, lowers the priority order of the other paper trays other than the paper tray A one by one and changes the priority order of the paper trays as shown in FIG. 20(*b*).

Next, the user puts the A4 paper on the paper feed device or the platen and instructs the start of the copy. The CPU 2 recognizes the paper size as A4 and determines the paper size as A4 from the set magnification='100%' and the paper tray='automation'. Next, the paper tray setting is investigated from the first priority order in the priority order of the paper trays and the A4 paper is checked. In this case, since the A4 paper is set in the paper tray A, the copy is performed by using the paper of the paper tray A.

After the copy job is completed, when the paper setting is returned to the original paper setting, the priority order of the paper trays at the time of the saved automatic paper selection is returned to the priority order of the paper tray at the time of the original automatic paper setting shown in FIG. 20(*a*).

According to the fifth embodiment, even though the paper having the same size as the exchanged paper is set in another paper tray and the paper tray is the paper tray having the priority order at the time of the automatic paper selection, when the setting of the paper quality is changed, since the priority order of the paper tray in which the exchanged paper is set is changed to the first priority at the time of the automatic paper selection, it is possible to suitably copy onto the paper exchanged by the user. In addition, the tray in which the setting of the paper quality of the paper is changed without changing the priority order of the paper tray can be set so as to be automatically selected. In this case, after the copy job is completed, when the paper setting is returned to the original paper setting, the tray selection state is returned to the original tray selection state.

In addition, the present invention is not limited the above-mentioned embodiments, various changes may be made without departing from the spirit and scope thereof. For example, after the paper quality is changed, when the copy job is completed, the message indicating the purport of changing the paper quality to the original paper quality may be displayed. Further, according to the embodiment, the work for returning the paper quality setting to the original paper quality is performed at the apparatus side, but may be performed by the general user. In addition, according to the embodiment, the paper quality setting is returned to the original paper quality setting when the insertion of the paper tray is detected, but the paper quality setting may be returned to the original paper setting when the pulling out of the paper tray is detected. In addition, even though the insertion or pulling out of the paper tray is not detected, the paper quality setting is automatically returned to the original paper quality setting at the time of auto clearing. In the image forming apparatus constructed such that the user is authenticated through the input of the user password or the insertion of the user authentication card, it may be controlled such that the paper quality is returned to the original paper quality on condition departing from the user authentication state in which the paper quality is changed.

In addition, while the paper quality is changed by the general user, the received print job from the external devices such as the facsimile or the print may be waited until the changed paper quality is returned to the original paper quality. In addition, only the received print job with respect to the corresponding paper tray may be waited or it may be controlled such that the alternative paper tray is used to perform output. By having this configuration, it can be prevented to perform the print onto the paper which is not intended with regard to the received print job from the outside.

The entire disclosure of Japanese Patent Application No. 2004-001476 filed on Jan. 6, 2004 and Japanese Patent Application No. 2004-339288 filed on Nov. 24, 2004 including specifications, claims, drawings and abstracts are incorporated therein by reference in their entirety.

What is claimed is:

1. An image forming apparatus for printing an image on paper, a paper quality of which is set for a paper feed tray, based on parameters corresponding to the paper quality, comprising:

a changing unit for changing a paper quality setting previously set for the paper feed tray;

a returning unit for returning the changed paper quality setting to the paper quality setting before change according to a predetermined condition after the paper quality setting is changed by the changing unit; and a storage unit for temporarily storing a default paper quality setting, wherein the storage unit sends the default paper quality setting to the returning unit for returning the changed paper quality setting to the paper quality setting before the change.

2. The image forming apparatus according to claim 1, wherein the predetermined condition in the returning unit is a condition when a job is completed with respect to the paper after changing the paper quality.

3. The image forming apparatus according to claim 1, wherein the predetermined condition in the returning unit is a condition when pulling of the paper feed tray out of the image forming apparatus or inserting of the paper feed tray into the image forming apparatus is detected.

4. The image forming apparatus according to claim 1, wherein the predetermined condition in the returning unit is a condition when a job is completed with respect to the paper after changing the paper quality and a predetermined time has elapsed.

5. The image forming apparatus according to claim 1, wherein when the predetermined condition is satisfied, the returning unit displays information which requests a user to change the paper accommodated in the paper feed tray to the paper before change.

6. The image forming apparatus according to claim 1, wherein when it is detected that pulling of the paper feed tray out of the image forming apparatus or inserting of the paper feed tray into the image forming apparatus, the returning unit displays information which requests a user to change the paper quality setting.

7. The image forming apparatus according to claim 1, wherein the changing unit prohibits an output of a print job received from an external device.

8. The image forming apparatus according to claim 1, wherein when a print job is received from an external device, the returning unit executes the print job after returning the paper quality setting to the paper quality setting before change.

9. The image forming apparatus according to claim 1, wherein when a print job that performs printing on the paper in the paper feed tray whose paper quality is changed is received from an external device, the changing unit performs printing on the paper in the paper feed tray whose paper quality is not changed.

10. The image forming apparatus according to claim 1, wherein when the paper having the paper quality after change is non-standard paper, the changing unit has a size setting section capable of setting a size of the non-standard paper, and the returning unit returns the paper quality setting to the paper quality setting before change and returns the size setting of the non-standard paper to the size setting before change.

11. The image forming apparatus according to claim 1, wherein when a setting for automatically returning the changed paper quality setting to the paper quality setting before change is given, the returning unit returns the changed paper quality setting to the paper quality setting before change.

12. The image forming apparatus according to claim 1, wherein the paper feed tray comprises a plurality of paper feed trays which is used according to a previously set priority order, and the changing unit changes the paper quality setting with respect to a paper feed tray selected among the plurality of paper feed trays and changes the priority order of the paper feed tray in which the paper quality is changed with the first priority order.

13. The image forming apparatus according to claim 1, wherein the default paper quality setting is defined by an apparatus manager.

14. The image forming apparatus according to claim 1, wherein the default paper quality setting may be changed if a user enters a password corresponding to a password defined by an apparatus manager.

15. An image forming apparatus for printing an image on paper, a paper quality of which is set for a paper feed tray, based on parameters corresponding to the paper quality, comprising:

a detecting unit for detecting pulling of the paper feed tray out of the image forming apparatus or inserting of the paper feed tray into the image forming apparatus;

a changing unit for displaying a paper quality setting changing screen for changing a paper quality setting previously set for the paper feed tray to accept changing of the paper quality setting, when the pulling of the paper feed tray out of the image forming apparatus or the inserting of the paper feed tray into the image forming apparatus is detected by the detecting unit;

a returning unit for returning the changed paper quality setting to the paper quality setting before change, when the pulling of the paper feed tray out of the image forming apparatus or the inserting of the paper feed tray into the image forming apparatus is detected by the detecting unit after the setting of the paper quality is changed by the changing unit and the image is printed based on the parameters corresponding to the paper quality after change; and a storage unit for temporarily storing a default paper quality setting, wherein the storage unit sends the default paper quality setting to the returning unit for returning the changed paper quality setting to the paper quality setting before the change.

16. The image forming apparatus according to claim 15, wherein the changing unit sets any one of three process including a process that the screen for changing the paper quality setting is displayed, a process that a method for displaying the screen for changing the paper quality setting is displayed, and a process that any operation is not performed, when the pulling of the paper feed tray out of the image forming apparatus or the inserting of the paper feed tray into the image forming apparatus is detected by the detecting unit.

* * * * *